US008262518B2

(12) United States Patent
Palomaki et al.

(10) Patent No.: US 8,262,518 B2
(45) **Date of Patent: *Sep. 11, 2012**

(54) ARROW POINT ALIGNMENT SYSTEM

(75) Inventors: Teddy D. Palomaki, Park City, UT (US); Kenny R. Giles, West Valley City, UT (US)

(73) Assignee: Easton Technical Products, Inc., Salt Lake City, UT (US)

( * ) Notice: Subject to any disclaimer, the term of this patent is extended or adjusted under 35 U.S.C. 154(b) by 14 days.

This patent is subject to a terminal disclaimer.

(21) Appl. No.: 12/815,311

(22) Filed: Jun. 14, 2010

(65) Prior Publication Data

US 2010/0248872 A1 Sep. 30, 2010

Related U.S. Application Data

(63) Continuation of application No. 11/613,104, filed on Dec. 19, 2006, now Pat. No. 7,811,186.

(51) Int. Cl.
*F42B 6/08* (2006.01)

(52) U.S. Cl. ..... 473/582; 473/583

(58) Field of Classification Search ..... 473/578, 473/582, 583

See application file for complete search history.

(56) References Cited

U.S. PATENT DOCUMENTS

| | | | |
|---|---|---|---|
| 2,265,564 | A | 12/1941 | Klopsteg |
| 2,289,284 | A | 7/1942 | Chandler |
| 2,589,137 | A | 3/1952 | Ramsey |
| 2,905,470 | A | 9/1959 | Hoyt, Jr. |
| 2,925,278 | A | 2/1960 | Sweetland |
| 3,164,385 | A | 1/1965 | Shure |
| 3,401,938 | A | 9/1968 | Bear |
| 4,504,063 | A | 3/1985 | LeBus |
| 4,505,482 | A | 3/1985 | Martin, Sr. |
| 4,558,868 | A | 12/1985 | Musacchia |
| 4,706,965 | A | 11/1987 | Schaar |
| 4,874,180 | A | 10/1989 | Fingerson et al. |
| 4,944,520 | A | 7/1990 | Fingerson et al. |
| 5,417,439 | A | 5/1995 | Bickel |
| 5,496,043 | A | 3/1996 | Ester |
| 5,611,542 | A | 3/1997 | Saunders |
| 5,636,846 | A | 6/1997 | Tinsley |
| 5,921,875 | A | 7/1999 | Bickel |
| 6,077,180 | A | 6/2000 | Adams, Jr. |
| 6,290,903 | B1 | 9/2001 | Grace, Jr. et al. |
| 6,530,853 | B1 | 3/2003 | Giannetti |

(Continued)

OTHER PUBLICATIONS

"Beman CCL System: the perfect match for carbon arrows," 1994 Beman Catalog, p. 19.

*Primary Examiner* — John Ricci
(74) *Attorney, Agent, or Firm* — Holland & Hart LLP

(57) ABSTRACT

An arrow apparatus is disclosed comprising an arrow point alignment structure having a tapered leading end disposed on an outer surface of an arrow shaft. The arrow point may also comprise a tapered aperture defined therein for receiving and mating with at least a portion of the tapered leading end of the arrow point alignment structure in order to bring the arrow point into axial alignment with the arrow shaft. The arrow point alignment structure may be integrally formed with, or affixed to, the outer surface of the arrow shaft or affixed to a portion of the arrow point. The arrow apparatus may also further comprise an insert at least partially disposed within the arrow shaft. The insert may comprise a first insert portion removably attached to a second insert portion that weighs less than the first insert portion. Various arrow points and corresponding methods are also disclosed.

30 Claims, 22 Drawing Sheets

U.S. PATENT DOCUMENTS

| | | | |
|---|---|---|---|
| 6,605,012 | B2 | 8/2003 | Muller |
| 6,726,581 | B2 | 4/2004 | Muller |
| 6,739,992 | B2 | 5/2004 | Kummerle |
| 6,939,258 | B2 | 9/2005 | Muller |
| 7,004,859 | B2 | 2/2006 | Palomaki et al. |
| 7,115,055 | B2 | 10/2006 | Palomaki et al. |
| 7,811,186 | B2 | 10/2010 | Palomaki et al. |
| 2005/0181898 | A1 | 8/2005 | Muller |
| 2006/0030439 | A1 | 2/2006 | Muller |
| 2007/0037640 | A1 | 2/2007 | Rager |

ARROW POINT ALIGNMENT SYSTEM

RELATED APPLICATION

This is a continuation of U.S. patent application Ser. No. 11/613,104 filed on 19 Dec. 2006, now pending, the disclosure of which is incorporated, in its entirety, by this reference.

FIELD OF THE INVENTION

The instant disclosure relates generally to the field of arrow systems, such as hunting and target arrow systems.

BACKGROUND

Over the years, various arrows and arrow systems have been developed for use in hunting and sport archery. Conventional arrow systems typically comprise an arrow shaft, an arrow point (such as a field point or a broadhead) permanently or removably attached to the leading or distal end of the arrow shaft, and a nock provided at the trailing or proximate end of the arrow shaft. A plurality of vanes or other fletching are also typically secured to the trailing end of the arrow shaft to facilitate proper arrow flight.

In conventional field point arrow systems, a field point may be removably attached to the arrow shaft using one or more insert components. For example, an insert having a shank portion, a lip portion, and a threaded end portion may be affixed within a hollow arrow shaft by inserting the shank portion into the hollow arrow shaft until the lip portion of the insert abuts an end wall of the arrow shaft. A field point having a threaded aperture defined therein may then be threaded onto the threaded end of the insert until the end wall of the field point seats against the lip portion of the insert. Removably attaching the field point to the arrow shaft in this manner enables archers to mix and match various field points and arrow shafts as may be required for differing hunting or sport archery applications.

Similarly, in conventional broadhead arrow systems, a broadhead may be removably attached to the arrow shaft using a component commonly known as a "ferrule." Conventional broadhead ferrules may comprise a shank portion having a threaded trailing end, a threaded leading end, and a conically shaped lip portion disposed between the leading and trailing ends. The ferrule may be attached to the arrow shaft by threading the threaded trailing end of the shank portion into a threaded bore located in the hollow arrow shaft until the flat end of the conically shaped lip portion abuts an end wall of the arrow shaft. A broadhead (which may comprise a plurality of blades extending from a common frontal point to a base, a tapered base collar connected to the base of each blade, and a threaded aperture defined in a central hub structure provided on the underside of each blade) may then be threaded onto the threaded leading end of the ferrule until the outer surface of the conically shaped lip portion is brought to bear against the inner surface of the tapered base collar, resulting in a tight engagement between the broadhead and the ferrule secured within the arrow shaft. As with conventional field point arrow systems, removably attaching the broadhead to the arrow shaft in this manner enables archers to mix and match various broadheads and arrow shafts as may be required for differing hunting or sport archery applications.

In certain conventional arrow systems (including both field point and broadhead arrow systems), the precise axial alignment of the arrow point with the arrow shaft depends upon at least four different sets of interfacing surfaces, all of which have the potential to adversely affect the axial alignment of the arrow point with the arrow shaft. For example, in field point arrow systems, a first interfacing surface set may comprise the trailing end wall of the field point and the flat leading end surface of the lip portion of the insert. Another set may comprise the flat trailing end surface of the lip portion of the insert and the end wall of the leading end of the arrow shaft. An additional set may comprise the cylindrical outer surface of the insert and the inside surface of the arrow shaft. Finally, the threaded end of the insert and the threaded aperture defined in the field point may comprise a further set of interfacing surfaces. Similarly, in broadhead arrow systems, a first interfacing surface set may comprise the flat trailing end surface of the conically shaped lip portion of the ferrule and the end wall of the leading end of the arrow shaft. Another set may comprise the outer surface of the conically shaped lip portion and the inner surface of the tapered base collar. An additional set may comprise the threaded trailing end of the ferrule and the threaded bore defined in the arrow shaft. Finally, the threaded leading end of the ferrule and the threaded aperture defined in the central hub structure of the broadhead may comprise a further set of interfacing surfaces.

Because any one of the foregoing interfacing surfaces may adversely affect the axial alignment of the arrow point with the arrow shaft (and thus potentially adversely affect arrow flight and accuracy), significant costs may be expended in an attempt to precisely manufacture and align each respective component in conventional arrow systems. Accordingly, there exists a need for a simple, accurate, reliable, and cost-effective apparatus and method for aligning an arrow point with an arrow shaft arrow in an arrow apparatus.

SUMMARY

According to at least one embodiment, an arrow apparatus comprises an arrow shaft having an outer surface, an inner surface, a leading end, and a trailing end, an arrow point alignment structure comprising a tapered leading end disposed on the outer surface of the arrow shaft proximate the leading end of the arrow shaft, and an arrow point attached to the leading end of the arrow shaft. In certain embodiments, at least a portion of the arrow point attached to the arrow shaft may contact at least a portion of the tapered leading end of the arrow point alignment structure disposed on the outer surface of the arrow shaft. The arrow point alignment structure may either be integrally formed with the outside surface of the arrow shaft or affixed to the outside surface of the arrow shaft. In an additional embodiment, the arrow point alignment structure may be affixed to a portion of the arrow point.

The arrow apparatus may also comprise an insert at least partially disposed within the arrow shaft. In at least one embodiment, the insert may be integrally formed with the arrow point alignment structure. The insert may also comprise a first insert portion removably attached to a second insert portion that weighs less than the first insert portion. In an additional embodiment, the arrow apparatus may comprise an insert completely disposed within the arrow shaft and an adapter having a first end removably attached to the insert within the arrow shaft and a second end removably attached to the arrow point.

In certain embodiments, the arrow point alignment structure comprises a lip portion that surrounds at least a portion of the leading end of the arrow shaft. The arrow point alignment structure may also comprise a tapered trailing end. In addition, the arrow apparatus may comprise a spacing structure disposed between the arrow point alignment structure and the outer surface of the arrow shaft, with the spacing structure comprising a first lip structure that surrounds at least a portion of the leading end of the arrow shaft and a second lip structure that surrounds the tapered trailing end of the arrow point alignment structure.

In at least one embodiment, the arrow point may be a field point having a tapered aperture defined therein that is configured to contact at least a portion of the tapered leading end of the arrow point alignment structure. In an additional embodiment, the arrow point may be a broadhead that comprises a tapered collar configured to contact at least a portion of the tapered leading end of the arrow point alignment structure. In many embodiments, the arrow point alignment structure brings the arrow point into axial alignment with the arrow shaft.

In an additional embodiment, an arrow point for attachment to an arrow shaft comprises a leading end, a trailing end, a threaded aperture defined within the arrow point proximate the leading end, and a tapered aperture defined within the arrow point proximate the trailing end. In certain embodiments, the tapered aperture may be configured to contact at least a portion of an arrow point alignment structure disposed on an outer surface of an arrow shaft. The arrow point may be a field point or a broadhead that comprises a tapered collar that defines the tapered aperture.

According to at least one embodiment, a method of making an arrow apparatus comprises providing an arrow shaft having an inner surface, an outer surface, a leading end, and a trailing end, disposing an arrow point alignment structure having a tapered leading end on the outer surface of the arrow shaft, and axially aligning the arrow point alignment structure with the arrow shaft. The method may also comprise mating the tapered leading end of the arrow point alignment structure with a tapered aperture defined within an arrow point. In addition, the method may comprise disposing at least a portion of an insert within the arrow shaft and attaching an arrow point to the insert. In an additional embodiment, the method may comprise completely disposing an insert within the arrow shaft, attaching an adapter to the insert, and attaching an arrow point to the adapter. The method may also further comprise affixing the arrow point alignment structure to a portion of the arrow point.

In certain embodiments, disposing an arrow point alignment structure on the outer surface of the arrow shaft comprises integrally forming the arrow point alignment structure with the outer surface of the arrow shaft. Alternatively, disposing an arrow point alignment structure on the outer surface of the arrow shaft may comprise affixing the arrow point alignment structure to the outer surface of the arrow shaft. In addition, disposing an arrow point alignment structure on the outer surface of the arrow shaft may also comprise spacing the arrow point alignment structure a predetermined distance from the leading end of the arrow shaft.

In an additional embodiment, an arrow point apparatus comprises an arrow shaft having an outer surface, an inner surface, a leading end, and a trailing end, an arrow point alignment structure comprising a tapered leading end disposed on the outer surface of the arrow shaft proximate the leading end of the arrow shaft, and an arrow point attached to the leading end of the arrow shaft. In certain embodiments, at least a portion of the arrow point attached to the arrow shaft extends over both the leading end of the arrow shaft and the tapered leading end of the arrow point alignment structure disposed on the outer surface of the arrow shaft to provide internal structural support for the arrow point.

In least one embodiment, an arrow apparatus may comprise an arrow shaft having an outer surface, an inner surface, a leading end, and a trailing end, and an arrow point alignment structure comprising a tapered leading end disposed on the outer surface of the arrow shaft proximate the leading end of the arrow shaft. An insert comprising a threaded end may also be affixed to the inner surface of the arrow shaft. The arrow apparatus may also comprise an arrow point comprising a threaded aperture configured to mate with the threaded end of the insert and a tapered aperture configured to contact at least a portion of the tapered leading end of the arrow point alignment structure. In at least one embodiment, the arrow point alignment structure brings the arrow point into axial alignment with the arrow shaft.

In certain embodiments, a broadhead arrow point apparatus may comprise an arrow shaft having an outer surface, an inner surface, a leading end, and a trailing end and a broadhead arrow point attached to the leading end of the arrow shaft. In at least one embodiment, the broadhead arrow point may comprise an arrow point alignment structure disposed about at least a portion of the arrow shaft proximate the leading end of the arrow shaft. In certain embodiments, this arrow point alignment structure may bring the broadhead arrow point into axial alignment with the arrow shaft.

Features from any of the above-mentioned embodiments may be used in combination with one another in accordance with the general principles described herein. These and other embodiments, features and advantages will be more fully understood upon reading the following detailed description in conjunction with the accompanying drawings and claims.

BRIEF DESCRIPTION OF THE DRAWINGS

The accompanying drawings illustrate a number of exemplary embodiments and are a part of the specification. Together with the following description, these drawings demonstrate and explain various principles of the instant disclosure.

Figure 1:
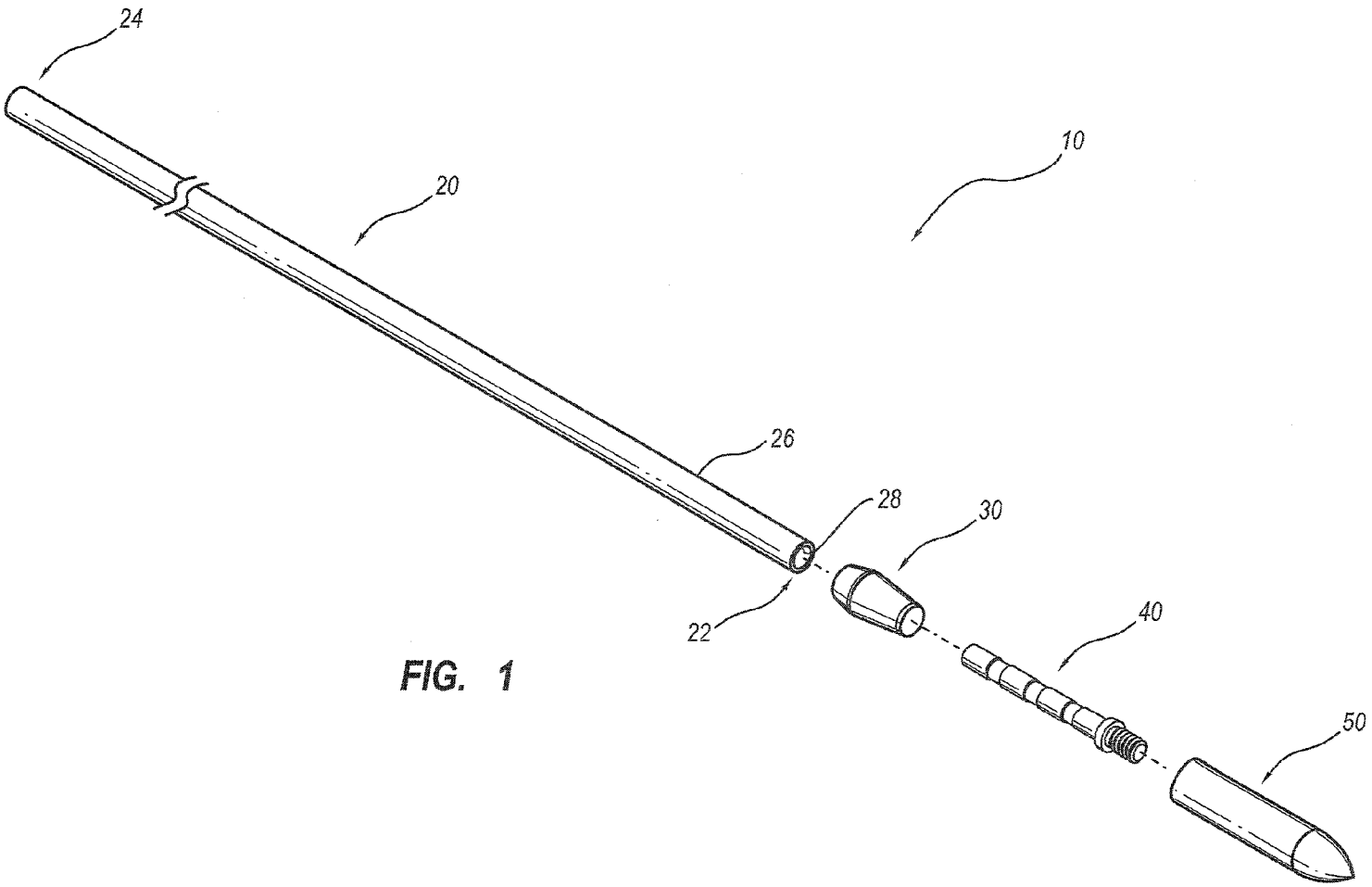
FIG. 1 is an exploded perspective view of an exemplary arrow apparatus according to at least one embodiment.

Throughout the drawings, identical reference characters and descriptions indicate similar, but not necessarily identical, elements. While the exemplary embodiments described herein are susceptible to various modifications and alternative forms, specific embodiments have been shown by way of example in the drawings and will be described in detail herein. However, one of skill in the art will understand that the exemplary embodiments described herein are not intended to be limited to the particular forms disclosed. Rather, the instant disclosure covers all modifications, equivalents, and alternatives falling within the scope defined by the appended claims.

DETAILED DESCRIPTION OF EXEMPLARY EMBODIMENTS

Figure 2:
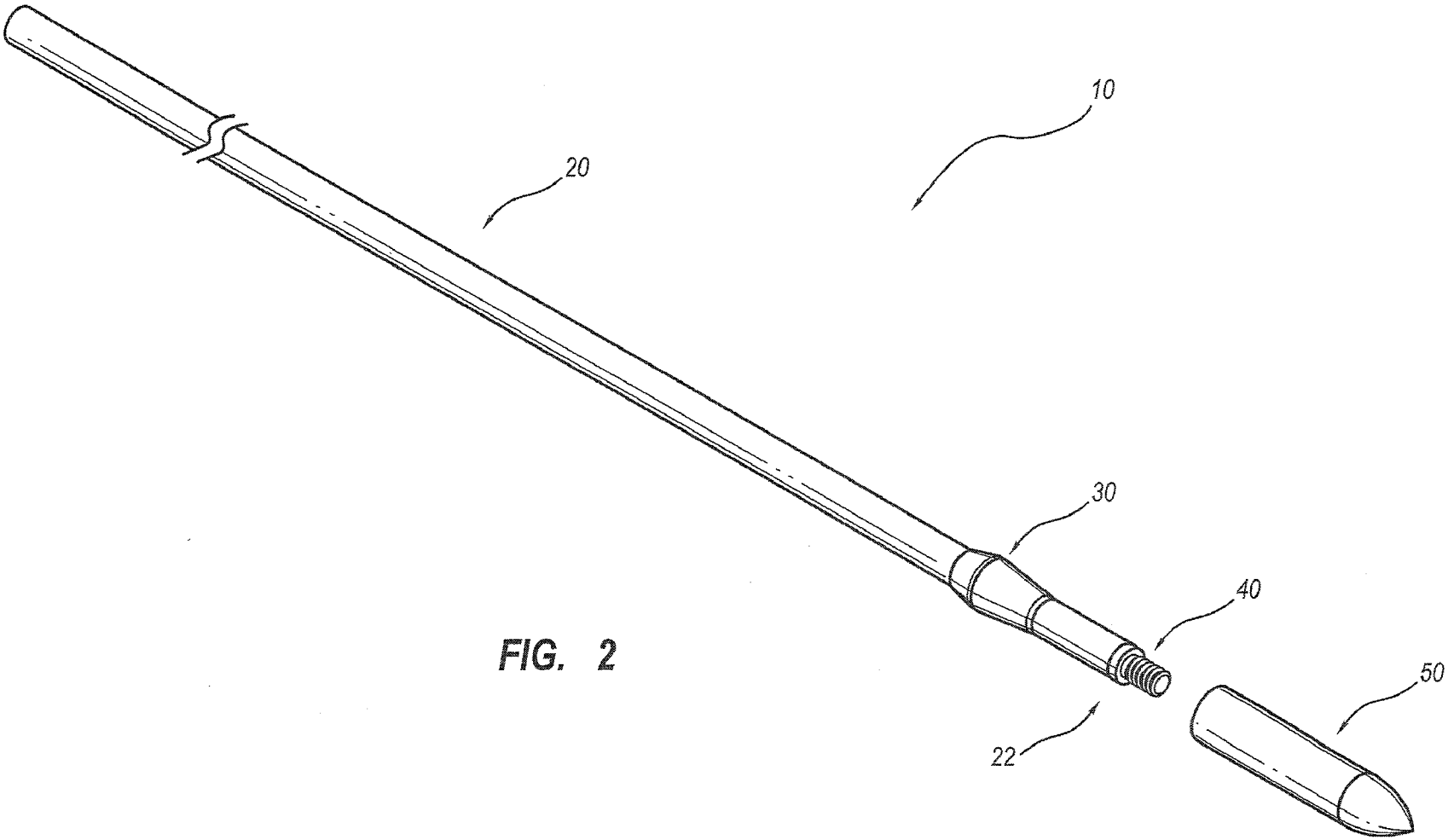
FIG. 2 is a partially assembled perspective view of the exemplary arrow apparatus illustrated in FIG. 1.
Figure 3:
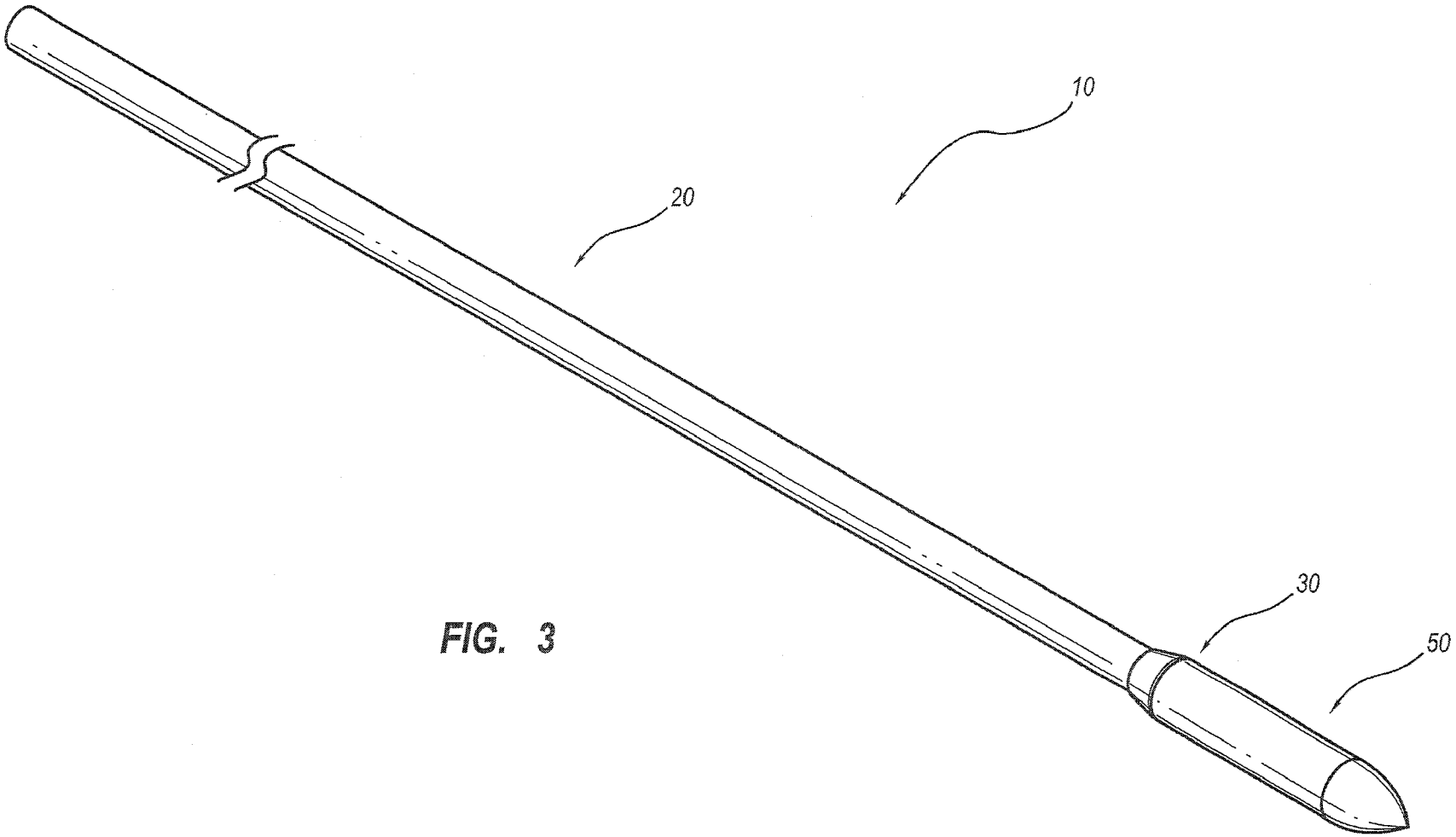
FIG. 3 is an assembled perspective view of the exemplary arrow apparatus illustrated in FIG. 1.

FIGS. 1-3 are perspective views of an exemplary arrow apparatus 10 according to at least one embodiment. As seen in these figures, exemplary arrow apparatus 10 may comprise an arrow shaft 20, an arrow point alignment structure 30, an insert 40, and an arrow point 50. "Arrow" means any elongated projectile with a point on the front or leading end and fletching or any other stabilizing structure on the back or trailing end, and shall include arrows for archery bows and arrows or bolts for crossbows. Arrow shaft 20 generally represents any form of arrow shaft known to those of ordinary skill in the art; including, for example, so-called fiber reinforced polymer (FRP) arrow shafts (such as fiberglass and carbon fiber composite arrow shafts), aluminum arrow shafts, and the like. In at least one embodiment, as seen in FIG. 1, arrow shaft 20 comprises a leading end 22, a trailing end 24, an outer surface 26, and an inner surface 28. The diameters of outer surface 26 and inner surface 28 may be varied as appropriate for differing hunting or sport archery applications.

Figure 4B:
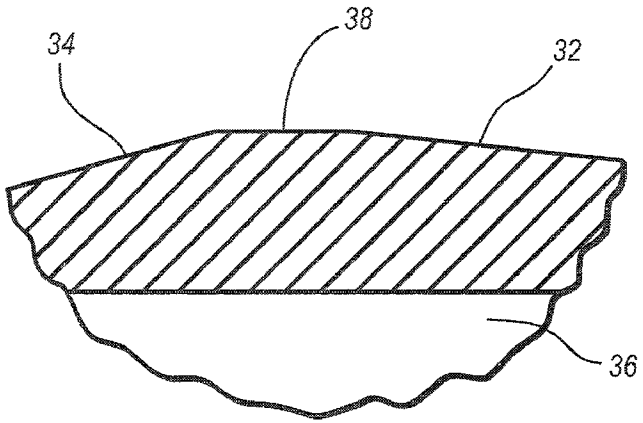
FIG. 4B is an enlarged cross-sectional view of a portion of the alignment structure shown in FIG. 4A.
Figure 4A:
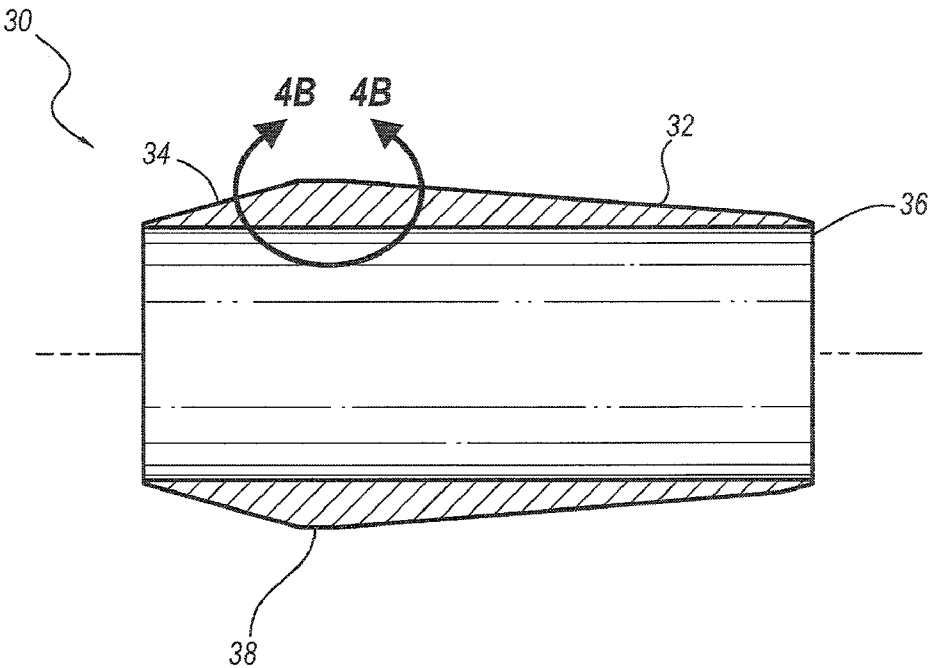
FIG. 4A is a cross-sectional side view of an exemplary arrow point alignment structure according to at least one embodiment.

FIG. 4A is a cross-sectional side view of the exemplary arrow point alignment structure 30 illustrated in FIGS. 1-3. As will be discussed in greater detail below, alignment structure 30 generally represents any structure configured to align the longitudinal axis of arrow point 50 with the longitudinal axis of arrow shaft 20. Arrow point alignment structure 30 may be manufactured in any number of shapes and sizes and may be adapted for use with arrow shafts of differing diameters. For example, as will be described in greater detail below, alignment structure 30 may either be discretely formed from, or integrally formed with, one or more of the components of exemplary arrow apparatus 10, such as arrow shaft 20 or insert 40. Alignment structure 30 may also comprise any number or combination of materials. For example, alignment structure 30 may be injection molded or formed of glass-filled nylon, aluminum, steel, brass, or any other suitable material.

As seen in FIGS. 4A and 4B, in at least one embodiment alignment structure 30 may comprise an inner surface 36 and an outer surface having a tapered leading end 32, a tapered trailing end 34, and a so-called flat or substantially cylindrical portion 38 (FIG. 4B) disposed between tapered leading end 32 and tapered trailing end 34. In certain embodiments, tapered leading end 32 and tapered trailing end 34 may be beveled, sloped, inclined, or substantially frustoconical in shape. In addition, and as discussed in greater detail below, the diameter of tapered leading end 32 may taper from a diameter approximately equal to the outer diameter of arrow shaft 20 to a diameter that is greater than or approximately equal to an outer diameter of arrow point 50 (at a point near the junction between tapered leading end 32 and tapered trailing end 34). In at least one embodiment, the diameter of inner surface 36 may be slightly greater than the outer diameter of arrow shaft 20 so that a portion of arrow shaft 20 may be disposed within alignment structure 30. For example, as seen in FIG. 2, leading end 22 of arrow shaft 20 may be inserted into and passed through alignment structure 30 until the leading end 22 of arrow shaft 20 extends past alignment structure 30. In certain embodiments, alignment structure 30 may be adhered, bonded, or otherwise affixed to the outer surface 26 of arrow shaft 20. Alternatively, as discussed in greater detail below in connection with FIGS. 15-16, alignment structure 30 may not be adhered or otherwise affixed to the outer surface of arrow shaft 26, thus allowing alignment structure 30 to freely slide along the outer surface 26 of arrow shaft 20.

In addition, inner surface 36 of alignment structure 30 and outer surface 26 of arrow shaft 20 may be shaped such that, when arrow shaft 20 is disposed within alignment structure 30, alignment structure 30 may be brought into axial alignment with arrow shaft 20. In other words, the cylindrically shaped inner surface 36 of alignment structure 30 may be proportional to, and just slightly larger than, the cylindrically shaped outer surface 26 of arrow shaft 20 so that the longitudinal axes of arrow shaft 20 and alignment structure 30 are brought into alignment with one another when arrow shaft 20 is inserted and disposed within alignment structure 30.

Figure 4C:
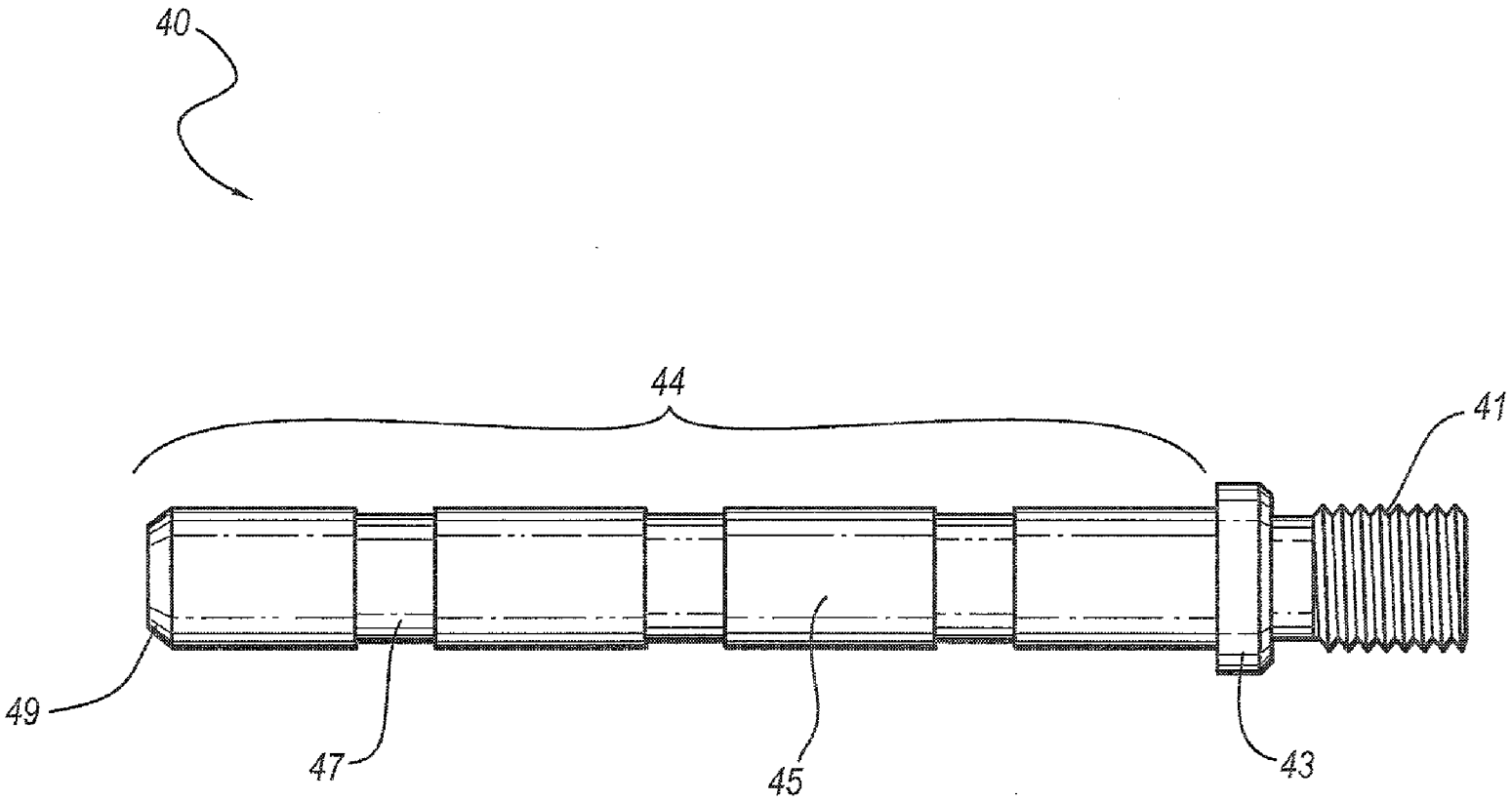
FIG. 4C is a side view of an exemplary insert according to at least one embodiment.

FIG. 4C is a side view of the exemplary insert 40 illustrated in FIGS. 1-3. Insert 40 generally represents any structure capable of being at least partially disposed within arrow shaft 20. Insert 40 may be formed in any number of shapes and sizes and of any combination of materials, such as aluminum, stainless steel, brass, or the like. For example, as discussed in greater detail below in connection with FIGS. 17-18, insert 40 may comprise a so-called hidden insert, such as the hidden insert embodiments described and illustrated in U.S. Pat. Nos. 7,004,859 and 7,115,055, the disclosures of which are incorporated herein in their entirety by this reference. The size of insert 40 may also be adapted as necessary for use with arrow shafts of varying sizes and diameters. In addition, as discussed in greater detail below, the weight of insert 40 may be adjusted by varying the materials used to form insert 40 or by varying the size and shape of insert 40. In the exemplary embodiment illustrated in FIG. 4C, insert 40 may comprise a threaded end 41, a lip portion 43, a shank portion 44, and a tapered end 49. Shank portion 44 may comprise a plurality of circumferential ridges 45 separated by a plurality of circumferential recess 47. In at least one embodiment, the diameter of shank portion 44 (i.e., the diameter of each ridge 45) may be less than the inner diameter of arrow shaft 20 so that a portion of insert 40 (e.g., shank portion 44) may be inserted within arrow shaft 20, as seen in FIG. 2. In contrast, the diameter of lip portion 43 may be greater than the inner diameter of arrow shaft 20 to prevent insert 40 from being completely inserted within arrow shaft 20. In at least one embodiment, the diameter of lip portion 43 is substantially equal to the outer diameter of arrow shaft 20. As shown in at least FIG. 6B, the insert 40, when inserted into the arrow shaft 20, may define a leading end of the arrow shaft 20 to which at least a portion of the arrow point 50 is mounted.

Figure 4D:
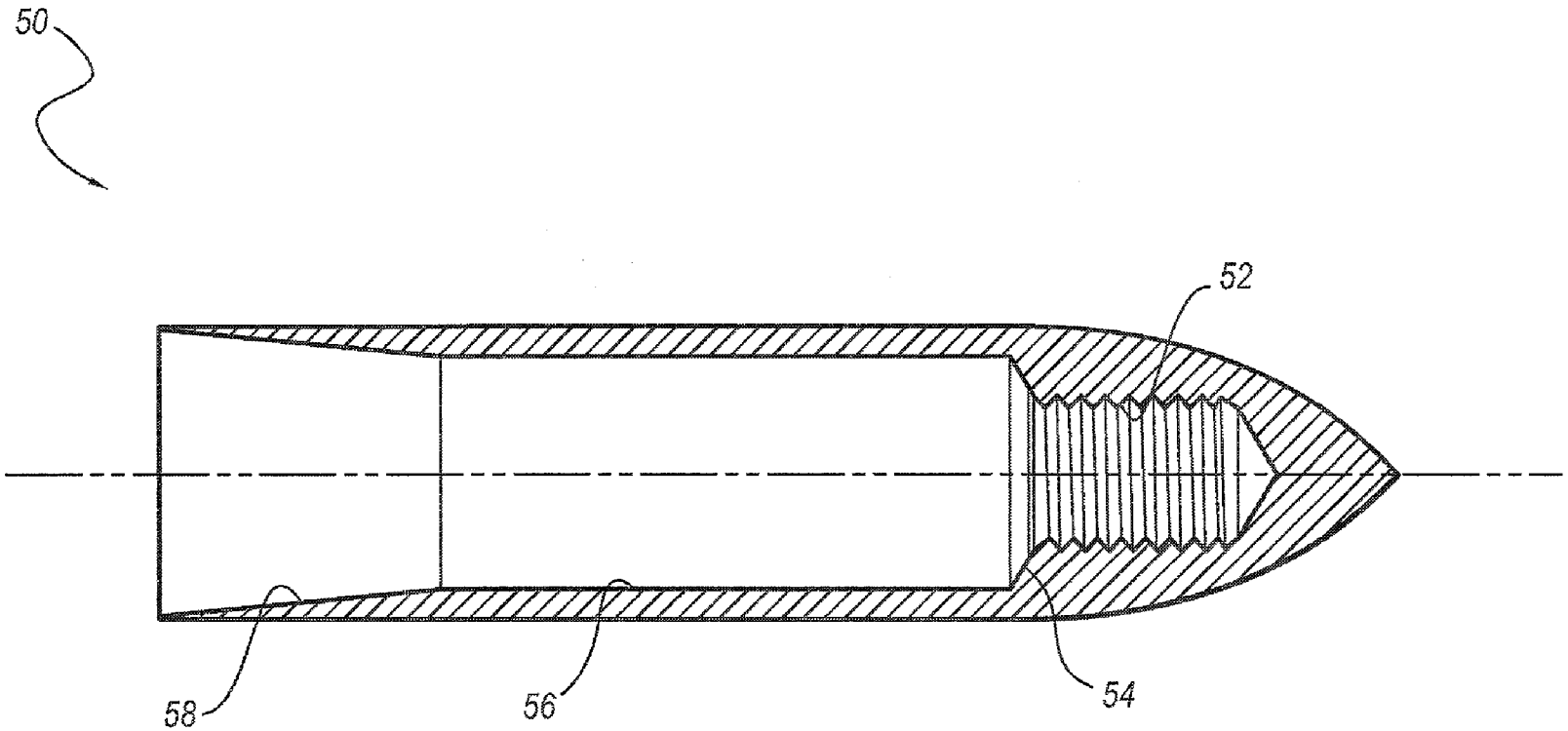
FIG. 4D is a cross-sectional side view of an exemplary arrow point according to at least one embodiment.

FIG. 4D is a cross-sectional side view of the exemplary arrow point 50 illustrated in FIGS. 1-3. Arrow point 50 generally represents any structure formed at or secured to the leading or distal end of an arrow shaft; including, for example, field points, broadheads (including expandable and replaceable fixed-blade broadheads), and the like. As seen in FIG. 4D, an internal aperture may be defined within arrow point 50 comprising a threaded portion 52, a shoulder portion 54, a substantially cylindrical portion 56, and a tapered portion 58. As will be discussed in greater detail below, arrow point 50 may be configured to receive at least a portion of insert 40, arrow point alignment structure 30, and/or arrow shaft 20. Arrow point 50 shown in FIGS. 1-4D as a unitary structure having a single-piece, integrally formed construction.

Figure 5:
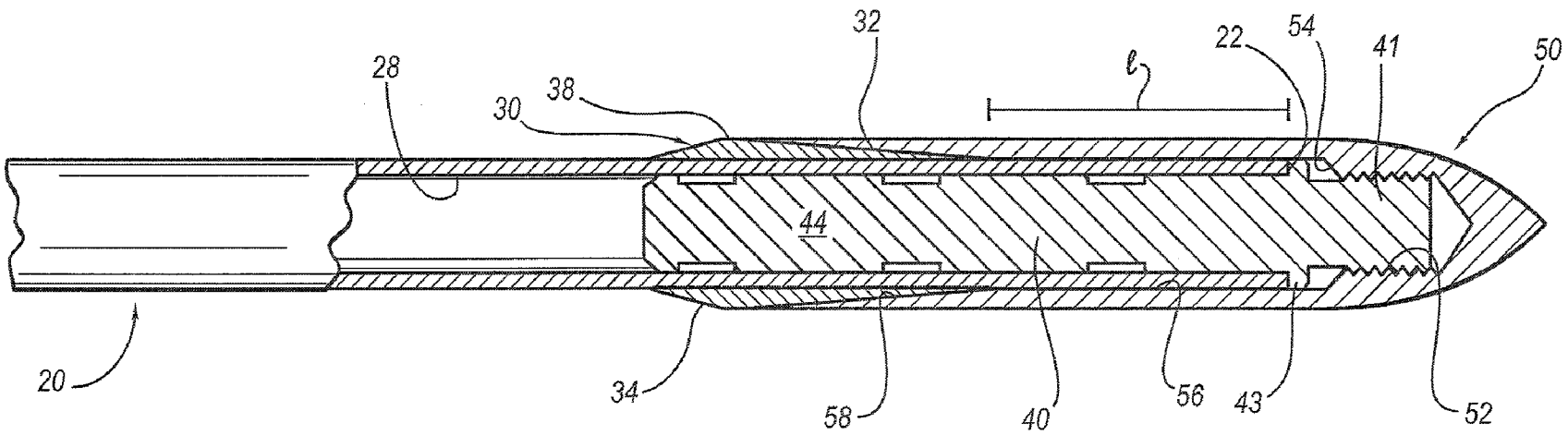
FIG. 5 is an assembled cross-sectional side view of the exemplary arrow apparatus illustrated in FIG. 3.

FIG. 5 is an assembled cross-sectional side view of the exemplary arrow apparatus 10 illustrated in FIGS. 1-3. As shown, shank portion 44 of insert 40 may be disposed within arrow shaft 20, with lip portion 43 of insert 40 abutting the leading end 22 (FIG. 2) of arrow shaft 20. In certain embodiments, shank portion 44 (FIG. 4B) of insert 40 may be adhered, bonded, or otherwise affixed to the inner surface 28 (FIG. 1) of arrow shaft 20. In addition, and as discussed previously, the leading end 22 of arrow shaft 20 may be inserted into and passed through arrow point alignment structure 30, as illustrated in FIGS. 2 and 5. As will be discussed in greater detail below, in many embodiments the terminating portion of tapered leading end 32 of alignment structure 30 may be positioned a predetermined distance from the leading end 22 of arrow shaft 20.

In at least one embodiment, and as seen in FIG. 5, threaded end 41 of insert 40 may be threaded into and mate with threaded portion 52 of arrow point 50. The threaded portion 52 may be referenced as a first contact point for the arrow point 50. In certain embodiments, the portion of arrow shaft 20 that houses shank portion 44 (FIG. 4C) of insert 40 may be disposed within substantially cylindrical portion 56 (FIG. 4D) of arrow point 50. In addition, as threaded end 41 of insert 40 is threaded into threaded portion 52 of arrow point 50, tapered portion 58 of arrow point 50 may contact, and more specifically may receive and mate with, the tapered leading end 32 of arrow point alignment structure 30. The tapered portion 58 may be referenced as a second contact point for the arrow point 50 that provides contact between the tapered portion 58 and the arrow point 50. The threaded portion 52 (i.e., first contact point) and tapered portion 58 (i.e., second contact point) are axially spaced apart. Tapered portion 58 may embody the inverse of the generally frustoconical shape of tapered leading end 32 of alignment structure 30 such that, as threaded end 41 is threaded into threaded portion 52 of arrow point 50, the outer surface of tapered leading end 32 may be brought to bear against the tapered portion 58 of the internal aperture defined within arrow point 50, resulting in a tight engagement between arrow point 50 and alignment structure 30, and thus alignment between the arrow point 50 and shaft 20.

As detailed above, tapered leading end 32 may taper from a diameter approximately equal to the outer diameter of arrow shaft 20 to a diameter that is greater than or approximately equal to an outer diameter of arrow point 50. In at least one embodiment, alignment structure 30 may be positioned on arrow shaft 20 so as to prevent threaded end 41 of insert 40 from being completely threaded into threaded portion 52 of arrow point 50. In other words, the distance between the tapered leading end 32 of alignment structure 30 and the leading end 22 of arrow shaft 20 may be chosen such that, as insert 40 is threaded into arrow point 50, the outer surface of tapered leading end 32 may bear against the inner surface of tapered portion 58 of the internal aperture defined within arrow point 50 to prevent lip portion 43 from contacting shoulder portion 54 of arrow point 50. Alternatively, the distance between the tapered leading end 32 of alignment structure 30 and the leading end 22 of arrow shaft 20 may be chosen so that lip portion 43 bears against shoulder portion 54 of arrow point 50 at the same time that the outer surface of tapered leading end 32 bears against the tapered portion 58 of the internal aperture defined within arrow point 50.

In at least one embodiment, tapered leading end 32 of alignment structure 30 may be shaped so as to bring arrow point 50 into axial alignment with alignment structure 30. In other words, as seen in FIG. 5, as the tapered portion 58 of the internal aperture defined within arrow point 50 mates with and is brought to bear against the outer surface of tapered leading end 32 of alignment structure 30, the frustoconical shape of tapered leading end 32 may guide arrow point 50 into axial alignment with alignment structure 30. Moreover, because, as explained in greater detail above, alignment structure 30 may be shaped and positioned so as to be in axial alignment with arrow shaft 20, alignment structure 30 may also bring arrow point 50 into axial alignment with arrow shaft 20.

Because in certain embodiments the shortened distance between the tapered leading end 32 of alignment structure 30 and the leading end 22 of arrow shaft 20 may prevent threaded end 41 of insert 40 from being completely threaded into threaded portion 52 of arrow point 50, many of the axial alignment difficulties experienced in conventional arrow systems may be eliminated. In addition, because arrow point 50 extends over and surrounds at least a portion of arrow shaft 20, as opposed to being cantilevered off the leading end 22 of arrow shaft 20, as with conventional arrow points, arrow point 50 may receive internal structural support from arrow shaft 20, thereby strengthening the attachment of arrow point 50 to arrow shaft 20. Thus, arrow point 50 may be axially aligned with arrow shaft 20 with greater accuracy and reliability than is possible with conventional arrow systems, resulting in improved arrow flight and accuracy. Additionally or alternatively, in certain embodiments where the distance between the tapered leading end 32 of alignment structure 30 and the leading end 22 of arrow shaft 20 is chosen to allow lip portion 43 to bear against shoulder portion 54 of arrow point 50, alignment structure 30 may help negate any alignment problems generated by the engagement of lip portion 43 with shoulder portion 54.

Figure 6A:
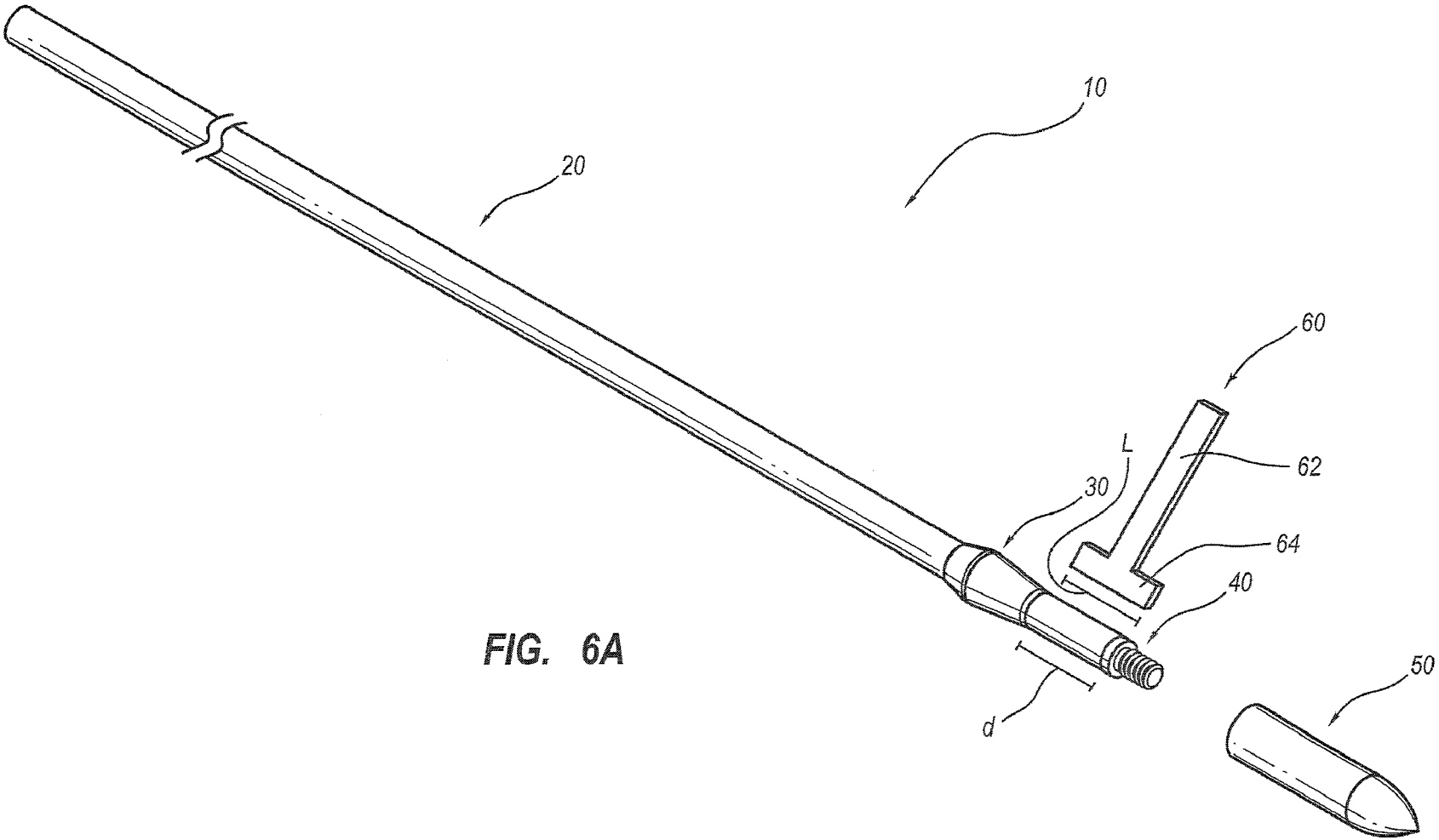
FIG. 6A is a partially assembled perspective view of an arrow apparatus according to an additional embodiment.
Figures 6B, 6C:
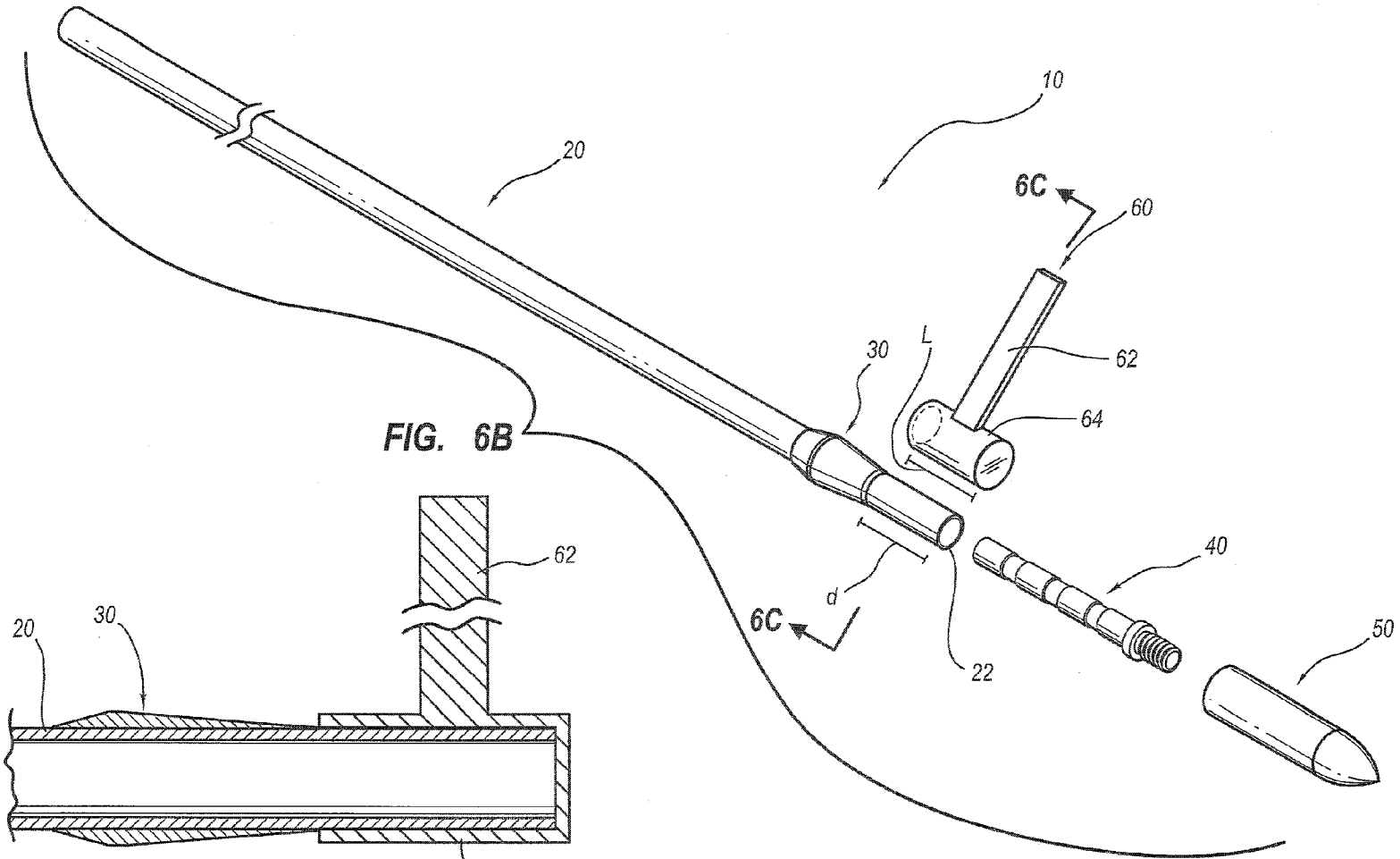
FIG. 6B is a partially assembled perspective view of an arrow apparatus according to an additional embodiment.
FIG. 6C is a cross-sectional view of the arrow apparatus of FIG. 6B.

As illustrated in the perspective views of FIGS. 6A and 6B, exemplary arrow apparatus 10 may also comprise a gauge 60. As shown in FIG. 6A, gauge 60 generally represents any structure or device useful in determining a preferred distance d from the leading end of alignment structure 30 to the front end of arrow shaft 20 (or, alternatively, to a front edge of insert 40). In at least one embodiment, gauge 60 comprises a leg portion 62 and a head portion 64 having a length L (FIG. 6A) that is equal to preferred distance d (FIGS. 6A and 6B). In certain embodiments, distance d may be less than, equal to, or greater than the length of the substantially cylindrical portion 56 defined in side arrow point 50, collectively designated as length l in FIG. 5. In embodiments where distance d is less than length l tapered leading end 32 may, as insert 40 is inserted into arrow point 50, bear against tapered portion 58 of arrow point 50 to prevent threaded end 41 of insert 40 from being completely threaded into the threaded portion 52 of arrow point 50, as explained in detail above. Alternatively, in embodiments where distance d is equal to length l, lip portion 43 may bear against shoulder portion 54 of arrow point 50 at the same time that the outer surface of tapered leading end 32 bears against the tapered portion 58 of the internal aperture defined within arrow point 50. In at least one embodiment, distance d is 0.5 inches.

In the exemplary embodiment illustrated in FIG. 6A, head portion 64 of gauge 60 may be placed alongside arrow shaft 20, with one end of head portion 64 positioned flush with the end wall of leading end 22 (FIG. 5) of arrow shaft 20. An edge of alignment structure 30 may then be brought into a butting relationship with the rear edge of gauge 60. Alignment structure 30 may then be adhered, bonded, or otherwise affixed to the outer surface 26 of arrow shaft 20, as discussed in detail above. Gauge 60 thus enables a user of exemplary arrow apparatus 10 to easily and accurately position alignment structure 30 a preferred distance from the end wall of the leading end 22 of arrow shaft 20.

Gauge 60 may be formed of any number or combination of materials, such as plastic, aluminum, steel, brass, or any other suitable material. Gauge 60 may also be formed in any number of shapes and sizes. For example, as illustrated in FIG. 6B, head portion 64 of gauge 60 may be substantially cylindrical and may have a cylindrical cavity defined therein for receiving leading end 22 of arrow shaft 20. In this exemplary embodiment, leading end 22 of arrow shaft 20 may be inserted into the cylindrical cavity of gauge 60 until leading end 22 abuts the end wall of the cylindrical cavity, as shown in FIG. 6C. Alignment structure 30 may then be brought into an abutting relationship with the rear edge of gauge 60. In an additional embodiment, head portion 64 may comprise a lip portion configured to rest against the end wall of the leading end 22 of arrow shaft 20 to ensure proper placement of gauge 60. In yet another embodiment, a gauge similar to what is shown in FIGS. 6B and 6C may be used with an aperture formed in the closed end to receive the threaded portion of insert 40, and the length L includes the thickness of lip portion 43 (FIG. 4C).

Figure 7:
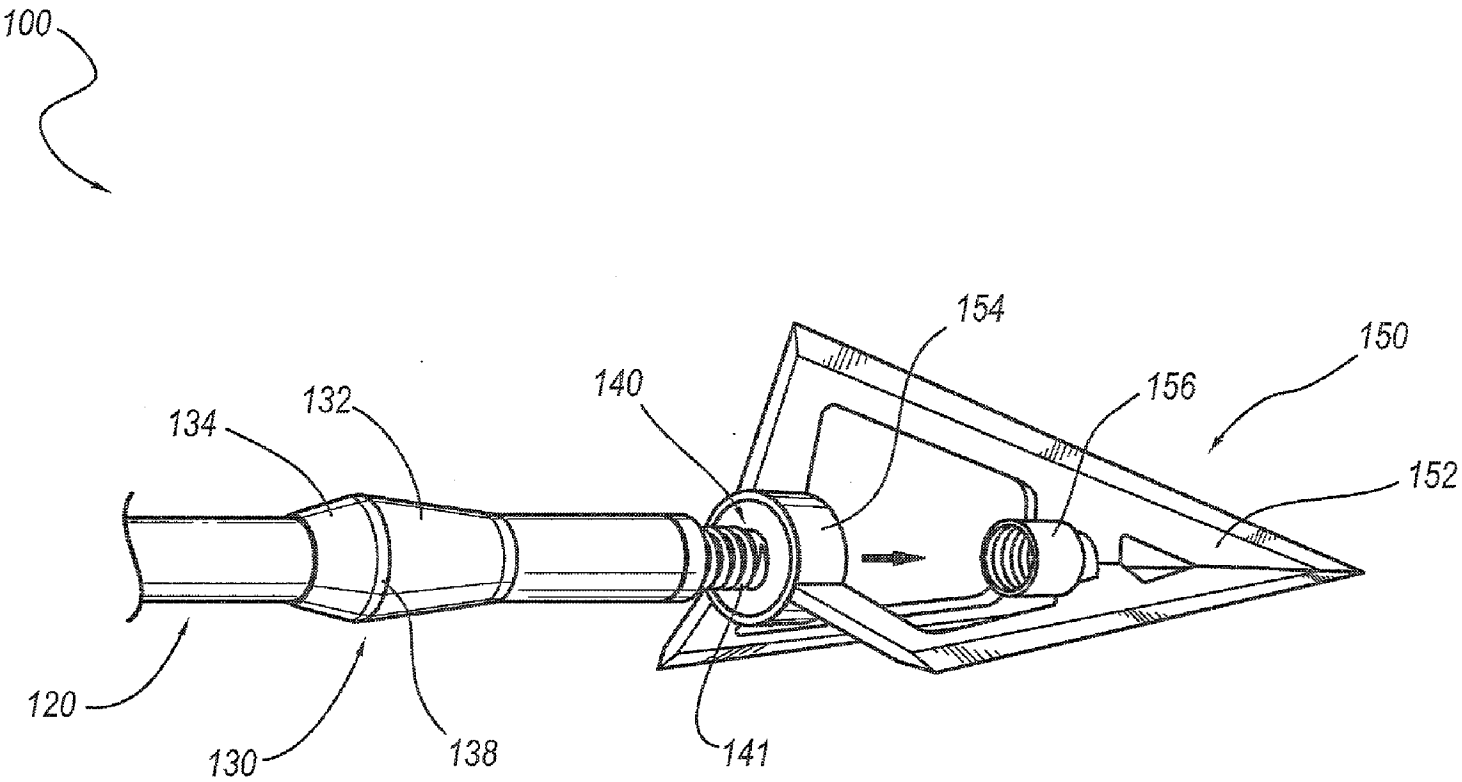
FIG. 7 is a partially assembled perspective view of an arrow apparatus according to an additional embodiment.
Figure 8:
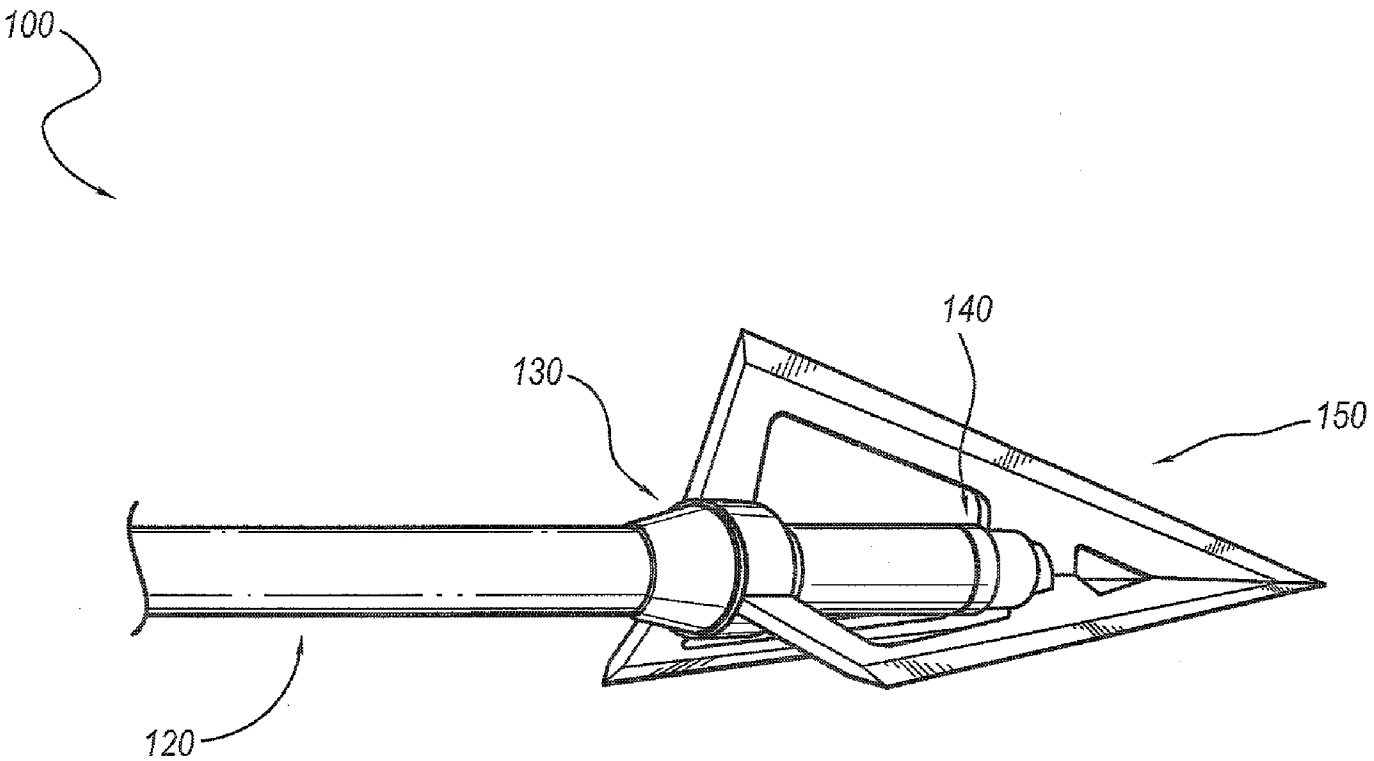
FIG. 8 is an assembled perspective view of the exemplary arrow apparatus illustrated in FIG. 7.

The preceding description has been provided to enable others skilled in the art to best utilize various aspects of the exemplary embodiments described herein. This exemplary description is not intended to be exhaustive or to be limited to any precise form disclosed. Many modifications and variations are possible without departing from the spirit and scope of the instant disclosure. For example, as illustrated in FIGS. 7 and 8, an exemplary arrow apparatus may comprise a broadhead-type arrow point 150, as opposed to the field point-type arrow point 50 previously described and illustrated. As seen in FIGS. 7 and 8, an exemplary arrow apparatus 100 may comprise an arrow shaft 120, an arrow point alignment structure 130, an insert 140, and a broadhead arrow point 150.

Broadhead 150 generally represents any form or type of broadhead; including, for example, unitary, expandable, and replaceable fixed-blade broadheads. FIGS. 7 and 8 show the broadhead 150 as unitary structure having a single-piece, integrally formed construction. In at least one embodiment, broadhead 150 comprises a plurality of blades 152 that each extend from a common frontal point to a base. In certain embodiments, the base of each blade 152 may be connected to a tapered collar 154. Tapered collar 154 may define a central aperture (also referred to as a collar aperture having a tapered surface) that is in axial alignment with a central hub structure 156 provided on the underside of each blade 152 and positioned between the common frontal point and tapered collar 154. Similar to threaded portion 52 of arrow point 50, central hub structure 156 may comprise a plurality of internal threads configured to receive and threadably mate with threaded end 141 of insert 140.

In at least one embodiment, the inner surface of tapered collar 154 may embody the inverse of the generally frustoconical shape of tapered leading end 132 of alignment structure 130. In addition, the diameter of tapered leading end 132 of alignment structure 130 may taper from a diameter approximately equal to the outer diameter of arrow shaft 120 to a diameter that is greater than or substantially equal to an outer diameter of tapered collar 154. Thus, as seen in FIG. 8, as threaded end 141 of insert 140 is threaded into central hub structure 156, tapered collar 154 of broadhead 150 may contact, or more specifically may receive and mate with, the tapered leading end 132 of arrow point alignment structure 130. That is, the outer surface of tapered leading end 132 may be brought to bear against the inner surface of tapered collar 154, resulting in a tight engagement between broadhead 150 and alignment structure 130.

As with exemplary arrow apparatus 10, alignment structure 130 in exemplary arrow apparatus 100 may be positioned on arrow shaft 120 so as to prevent threaded end 141 of insert 140 from being completely threaded into central hub structure 156. In other words, the distance between the tapered leading end 132 of alignment structure 130 and the leading end of arrow shaft 120 may be chosen such that, as insert 140 is threaded into central hub structure 156, the outer surface of tapered leading end 132 may bear against the inner surface of tapered collar 154 to prevent the lip portion of insert 140 from abutting a shoulder portion defined in central hub structure 156. Alternatively, the distance between the tapered leading end 132 of alignment structure 130 and the leading end of arrow shaft 120 may be chosen so that the lip portion of insert 140 bears against a shoulder portion defined in central hub structure 156 at the same time that the outer surface of tapered leading end 132 bears against the inner surface of tapered collar 154.

Similar to alignment structure 30, tapered leading end 132 of alignment structure 130 may be shaped so as to bring broadhead 150 into axial alignment with alignment structure 130. In other words, as seen in FIGS. 7 and 8, as tapered collar 154 mates with and is brought to bear against the outer surface of tapered leading end 132 of alignment structure 130, the frustoconical shape of tapered leading end 132 may guide broadhead 150 into axial alignment with alignment structure 130. Moreover, because alignment structure 130 may be shaped and positioned so as to be in axial alignment with arrow shaft 120, alignment structure 130 may also bring broadhead 150 into axial alignment with arrow shaft 120.

Because in certain embodiments the shortened distance between the tapered leading end 132 of alignment structure 130 and the leading end of arrow shaft 120 may prevent threaded end 141 of insert 140 from being completely threaded into central hub structure 156, many of the axial alignment difficulties experienced in conventional broadhead arrow systems may be eliminated. In addition, because broadhead 150 extends over and surrounds at least a portion of arrow shaft 120, as opposed to being cantilevered off the leading end of arrow shaft 120, as with conventional broadheads, broadhead 150 may receive internal structural support from arrow shaft 120, thereby strengthening the attachment of broadhead 150 to arrow shaft 120, and thus the entire arrow/broadhead assembly. Exemplary arrow apparatus 100 may also eliminate the need for the use of conventional ferrules and ferrule assemblies, and accordingly comprises a ferruleless broadhead system. Thus, broadhead 150 may be axially aligned with arrow shaft 120 with greater accuracy and reliability than is possible with conventional broadhead arrow systems, resulting in improved arrow flight and accuracy. Additionally or alternatively, in certain embodiments where the distance between the tapered leading end 132 of alignment structure 130 and the leading end of arrow shaft 120 is chosen to allow the lip portion of insert 140 to bear against the shoulder portion defined in central hub structure 156, alignment structure 130 may help negate any alignment problems generated by the engagement of the lip portion of insert 140 with the shoulder portion of central hub structure 156.

Figure 9:
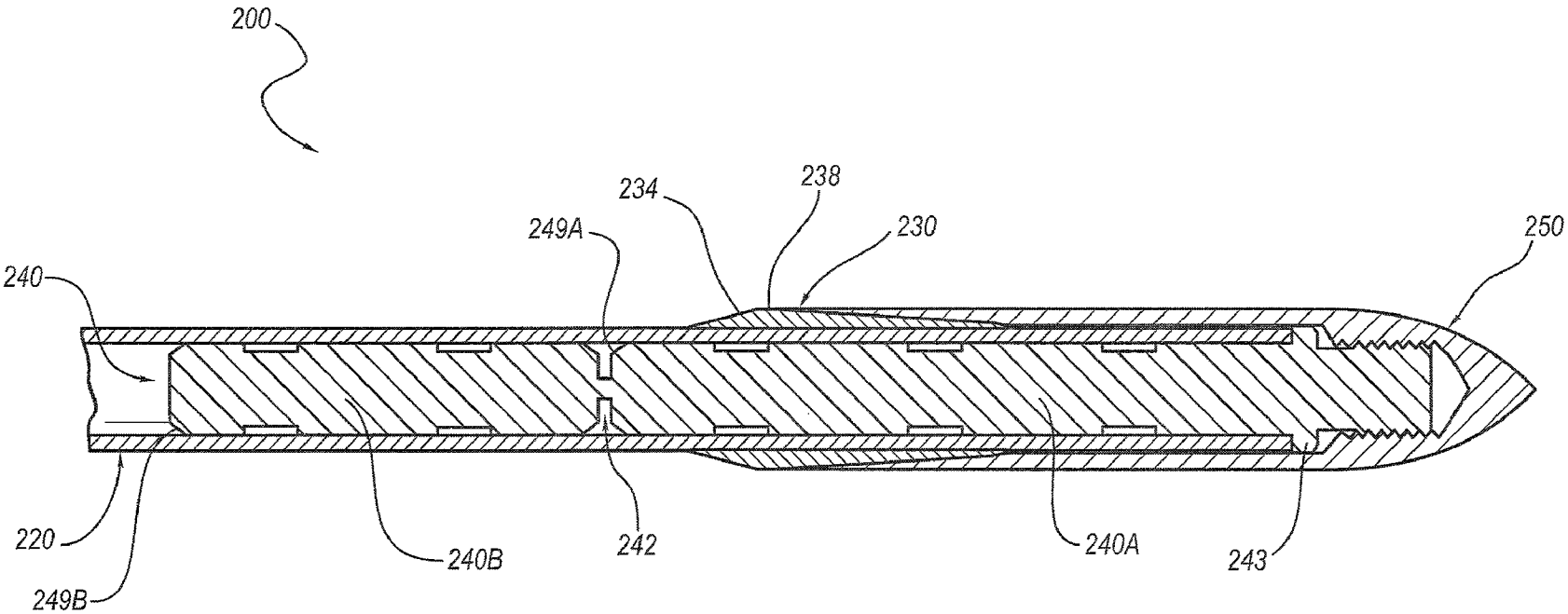
FIG. 9 is a cross-sectional side view of an arrow apparatus according to an additional embodiment.

As detailed above, the weight of the exemplary inserts described and/or illustrated herein may be adjusted by varying the materials used to form the insert or by varying the size and shape of the insert. FIG. 9 is a cross-sectional side view of an arrow apparatus 200 comprising a weight-adjustable insert. As seen in this figure, arrow apparatus 200 may comprise an arrow shaft 220, an arrow point alignment structure 230 (having similar characteristics as discussed above, including a tapered trailing end 234 and a substantially cylindrical portion 238) and an arrow point 250. Arrow apparatus 200 may also comprise a weight-adjustable insert 240 having a first insert portion 240A and a second insert portion 240B. As with insert 40, first and second insert portions 240A and 240B may comprise a plurality of circumferential ridges separated by a plurality of circumferential recesses. Insert portions 240A and 240B may also respectively comprise tapered ends 249A and 249B. In addition, as illustrated in FIG. 9, first insert portion 240A may be connected to second insert portion 240B by a breakable connector 242.

As with insert 40, insert portions 240A and 240B may be formed in any number of shapes and sizes and of any combination of materials, such as aluminum, stainless steel, brass, or the like. In certain embodiments, first insert portion 240A may be formed to have a weight that is different from the weight of second insert portion 240B. For example, first insert portion 240A may be formed to have a granular weight of 42 grains, while second insert portion 240B may be formed to have a granular weight of 15 grains. Other weights for first and second insertion portions 240A and 240B may also be chosen as desired. In at least one embodiment, a user of exemplary arrow apparatus 200 may reduce the total weight of insert 240 by breaking the connection 242 between first insert portion 240A and second insert portion 240B and removing second insert portion 240B. For example, in one embodiment the total weight of insert 240 may be reduced from 57 grains to 42 grains by breaking connection 242 (before installation, of course) between first insert portion 240A (which may have a granular weight of 42 grains) and second insert portion 240B (which may have a granular weight of 15 grains) and disposing of second insert portion 240B. Those skilled in the art will understand that more than two insert portions may be used, as desired and appropriate.

Weight-adjustable insert 240 thus provides a simple and effective means for adjusting the weight of the insert used in exemplary arrow apparatus 240, which insert accounts for a portion of the front-end weight of the assembled arrow. Thus, a user of exemplary arrow apparatus 240 may adjust the front-end weight of the arrow apparatus simply by breaking the connection 242 between first insert portion 240A and second insert portion 240B and disposing of second insert portion 240B. Advantageously, weight-adjustable insert 240 may be adapted for use in connection with multiple types and sizes of arrow shafts and arrow points; including, for example, both field point and broadhead arrow points.

In at least one embodiment, such as the embodiment shown in FIG. 9, tapered end 249A of first insert portion 240A may be positioned directly below the tapered trailing end 234 of alignment structure 230, with connection 242 extending beyond the tapered trailing end 234 of alignment structure 230. In certain embodiments, positioning first insert portion 240A within arrow shaft 220 in this manner enables the weight-adjustable insert 240 to provide support for arrow point 250, even if second insert portion 240B is broken off and removed.

Figure 10:
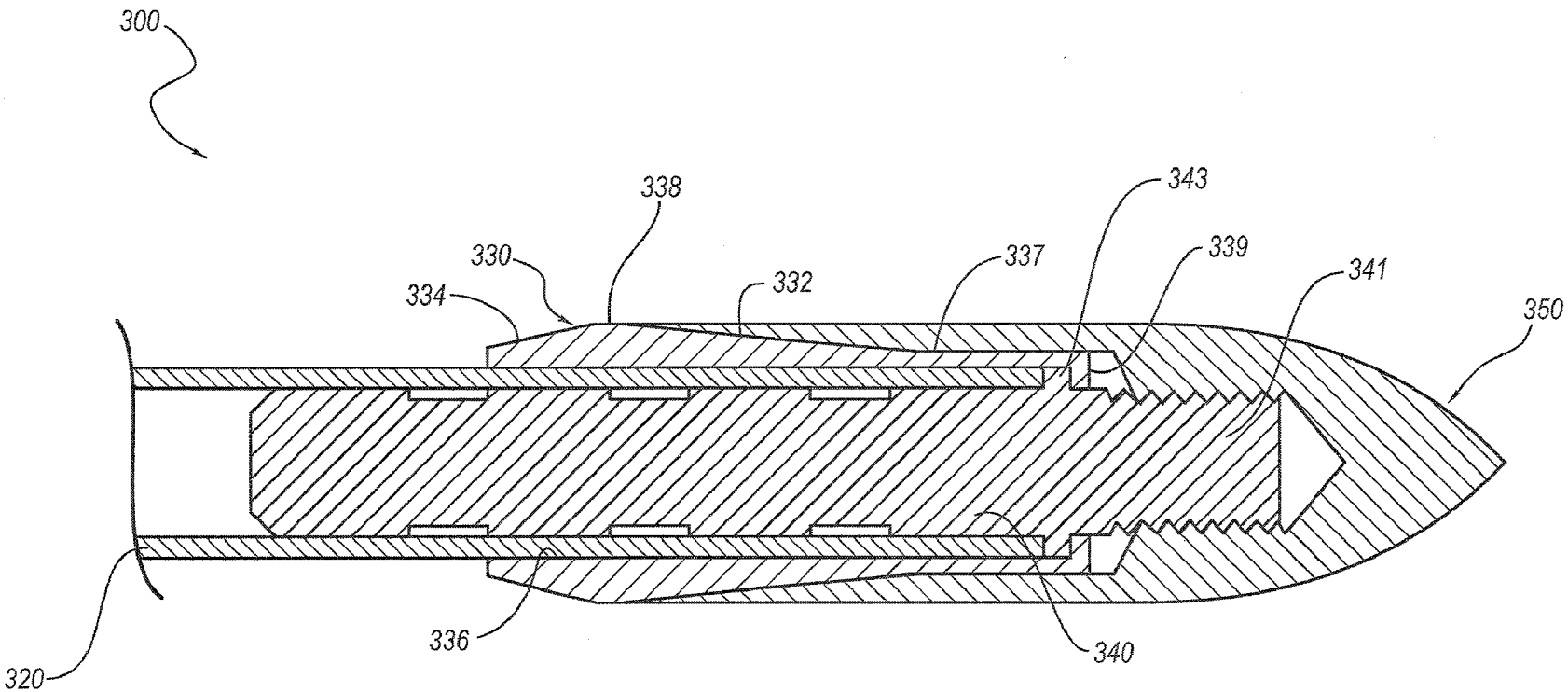
FIG. 10 is a cross-sectional side view of an arrow apparatus according to an additional embodiment.

FIG. 10 is a cross-sectional side view of an arrow apparatus 300 according to an additional embodiment. As seen in this figure, exemplary arrow apparatus 300 may comprise an arrow shaft 320, an arrow point alignment structure 330, an insert 340, and an arrow point 350. In at least one embodiment, alignment structure 330 may comprise a substantially cylindrical inner surface 336 and an outer surface comprising a tapered leading end 332, a tapered trailing end 334, a first substantially cylindrical portion 338, a second substantially cylindrical portion 337, and a lip portion 339. As with alignment structure 30 discussed above, the diameter of inner surface 336 may be slightly greater than the outer diameter of arrow shaft 320 so that a portion of arrow shaft 320 may be disposed within alignment structure 330. However, in contrast to alignment structure 30, lip portion 339 may be formed to have an inner diameter that is less than the outer diameters of both arrow shaft 320 and lip portion 343 of insert 340. Thus, in certain embodiment embodiments, lip portion 339 of alignment structure may surround lip portion 343 of insert 340 and prevent the leading end of arrow shaft 320 from passing through the leading end of alignment structure 330. In at least one embodiment, lip portion 339 may serve to position tapered leading end 332 of alignment structure 330 a preferred distance (discussed in greater detail above) from the end wall of the leading end of arrow shaft 320.

Figure 11:
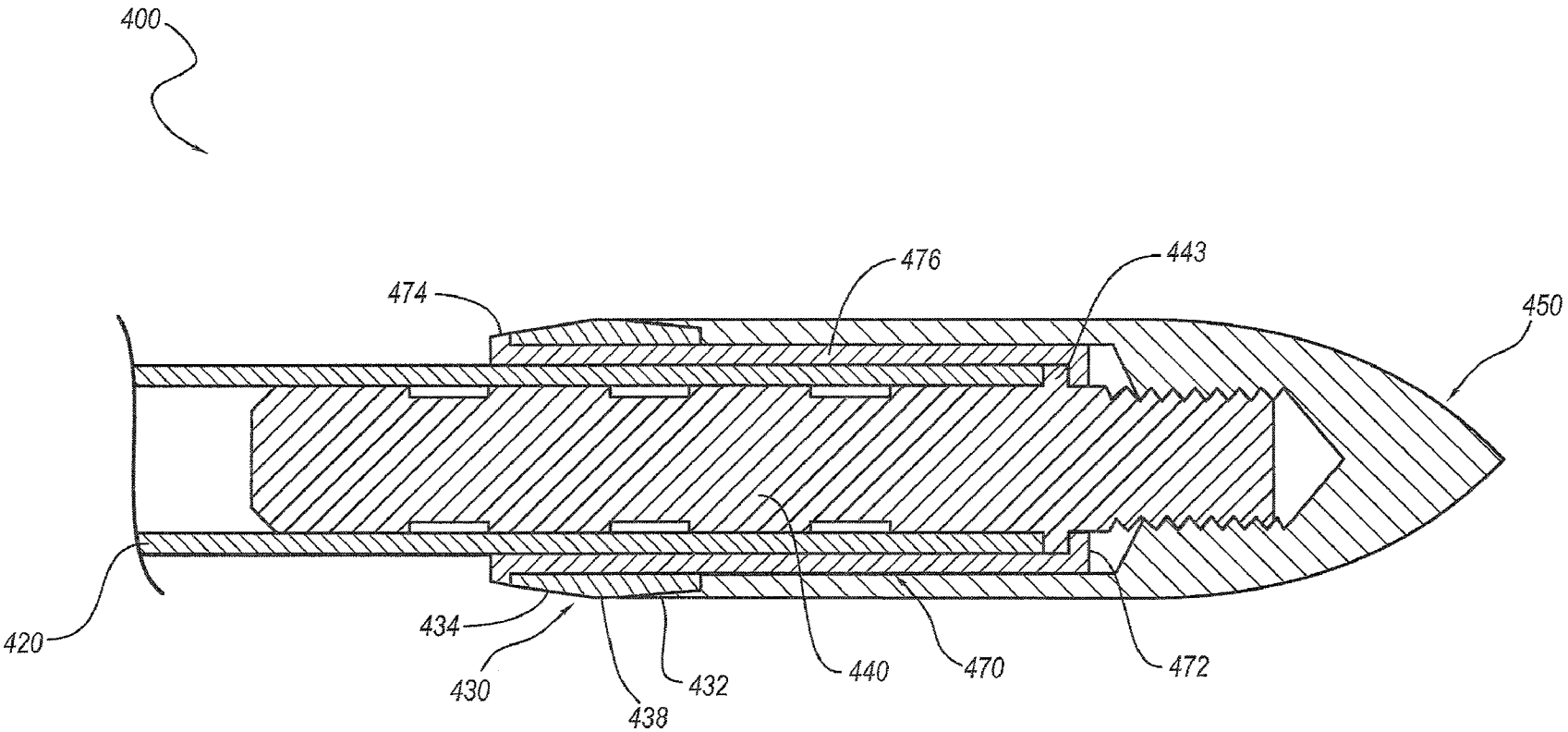
FIG. 11 is a cross-sectional side view of an arrow apparatus according to an additional embodiment.

FIG. 11 is a cross-sectional side view of an arrow apparatus 400 according to an additional embodiment. As seen in this figure, exemplary arrow apparatus 400 may comprise an arrow shaft 420, an arrow point alignment structure 430 having a tapered leading end 432, a tapered trailing end 434, and a substantially cylindrical portion 438, an insert 440, an arrow point 450, and a spacing structure 470. In at least one embodiment, spacing structure 470 may comprise a substantially cylindrical portion 476 surrounded by a first lip portion 472 and a second lip portion 474. In certain embodiments, the inner diameter of substantially cylindrical portion 476 may be slightly greater than the outer diameter of arrow shaft 420 so that a portion of arrow shaft 420 may be disposed within spacing structure 470. In addition, the inner diameter of first lip portion 472 may be less than the outer diameters of both arrow shaft 420 and lip portion 443 of insert 440 so that first lip portion 472 may surround lip portion 443 of insert 440 and prevent arrow shaft 420 from passing through the leading end of spacing structure 470. Further, second lip portion 474 may have an outer diameter that is greater than the diameter of tapered trailing end 434 of alignment structure 430. Those skilled in the art will understand that break-off portions may be used with virtually any insert used in connection with the various embodiments of the invention.

After at least a portion of insert 440 has been positioned within arrow shaft 420, insert 440 and arrow shaft 420 may be inserted into the trailing end of spacing structure 470 until lip portion 443 of insert 440 abuts first lip portion 472 of spacing structure 470. If desired, spacing structure 470 may be adhered, bonded, or otherwise affixed to the outer surface of arrow shaft 420. Alignment structure 430 may then be slid over the leading end of spacing structure 470 and the tapered trailing end 434 of alignment structure 430 may be brought into abutment with second lip portion 474 of spacing structure 470. Alignment structure 430 may (or may not) then be adhered, bonded, or otherwise affixed to the outer surface of spacing structure 470. Accordingly, in at least one embodiment, spacing structure 470 may serve to position alignment structure 430 a preferred distance (discussed in greater detail above) from the end wall of the leading end of arrow shaft 420, and may also provide some reinforcement to prevent the whole tip assembly from sliding backward during target impact.

Figure 12:
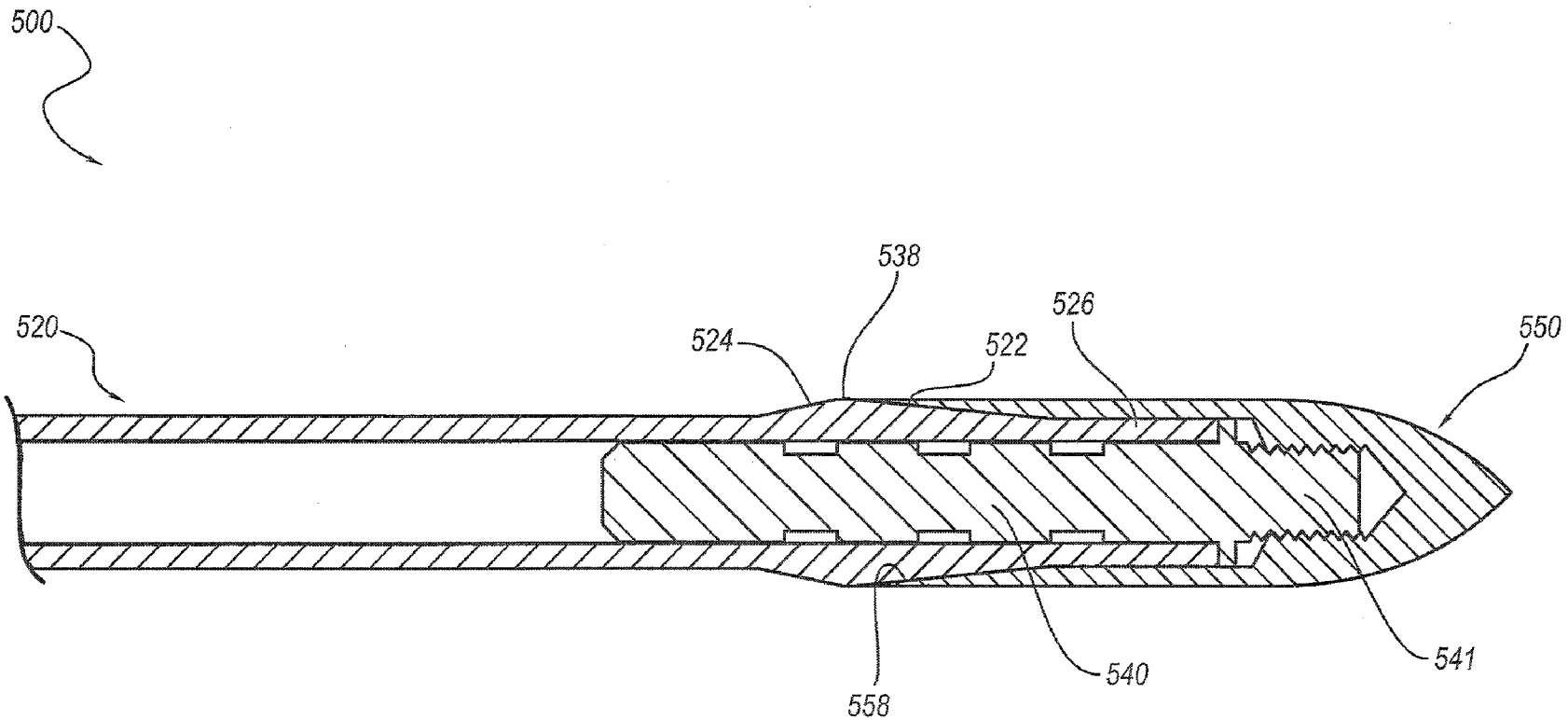
FIG. 12 is a cross-sectional side view of an arrow apparatus according to an additional embodiment.

FIG. 12 is a cross-sectional side view of an arrow apparatus 500 according to an additional embodiment. As seen in this figure, exemplary arrow apparatus 500 may comprise an arrow shaft 520, an insert 540, and an arrow point 550. Rather than comprising a discretely formed alignment structure (such as alignment structure 30 in FIGS. 1-3), in at least one embodiment arrow shaft 520 may comprise a tapered leading end 522, a tapered trailing end 524, a first substantially cylindrical portion 538, and a second substantially cylindrical portion 526 formed integrally with its outer surface. As with alignment structure 30, in certain embodiments tapered leading end 522 and tapered trailing end 524 may be substantially frustoconical in shape. In addition, tapered leading end 522 may taper from a diameter approximately equal to the outer diameter of substantially cylindrical portion 526 to a diameter that is greater than or approximately equal to an outer diameter of arrow point 550.

In at least one embodiment, and as seen in FIG. 12, as threaded end 541 of insert 540 is threaded into arrow point 550, the outer surface of tapered leading end 522 may be brought to bear against tapered portion 558 of the internal aperture defined within arrow point 550, resulting in a tight engagement between arrow point 550 and arrow shaft 520. Similar to previous embodiments, the frustoconical shape of tapered leading end 522 may guide arrow point 550 into axial alignment with arrow shaft 520.

Figure 13:
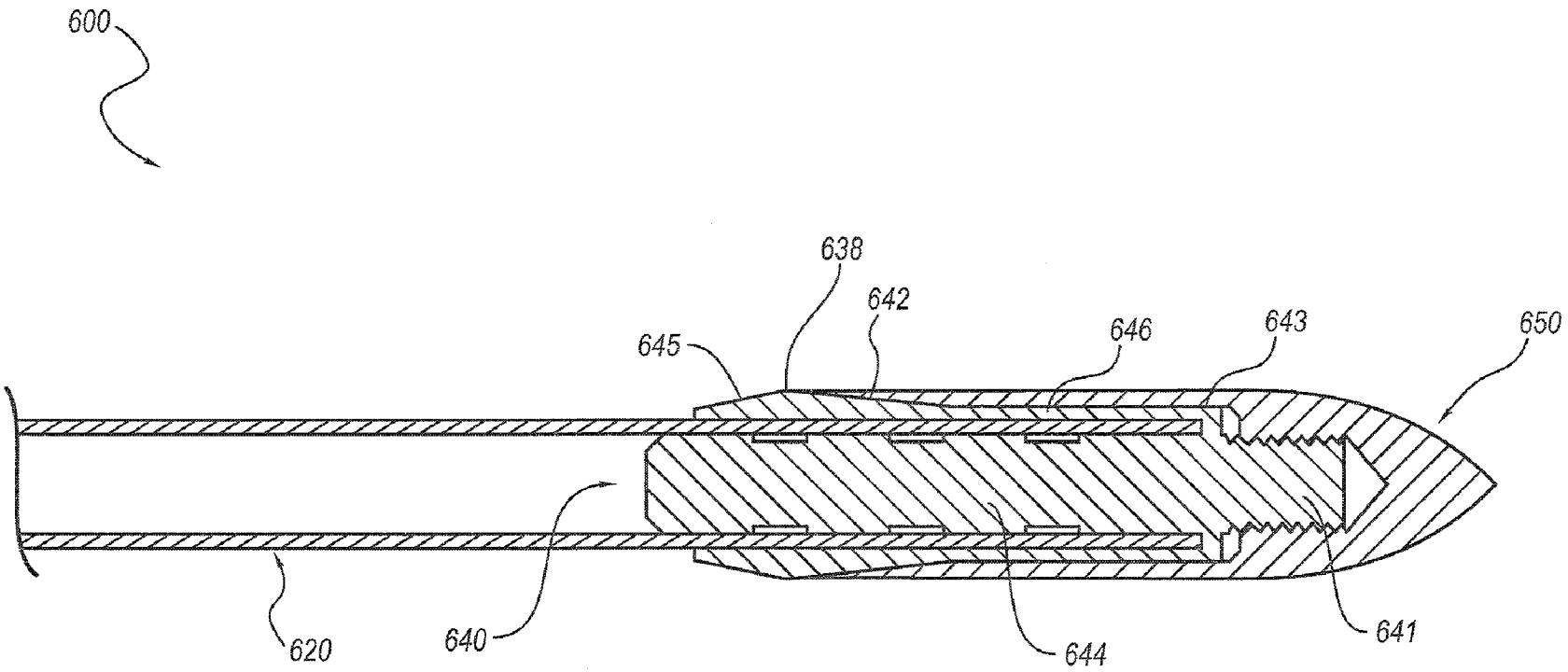
FIG. 13 is a cross-sectional side view of an arrow apparatus according to an additional embodiment.

FIG. 13 is a cross-sectional side view of an arrow apparatus 600 according to an additional embodiment. As seen in this figure, exemplary arrow apparatus 600 may comprise an arrow shaft 620, an insert 640, and an arrow point 650. Similar to insert 40, insert 640 may comprise a threaded end 641, a lip portion 643, and a shank portion 644. In certain embodiments, shank portion 644 of insert 640 may be adhered, bonded, or otherwise affixed to the inner surface of arrow shaft 620. In addition, as opposed to having a discretely formed alignment structure (such as alignment structure 30), a tapered leading end 642, a tapered trailing end 645, a first substantially cylindrical portion 638, and a second substantially cylindrical portion 646 may be integrally formed with insert 640. As with alignment structure 30, in certain embodiments tapered leading end 642 and tapered trailing end 645 may be substantially frustoconical in shape. In addition, tapered leading end 642 may taper from a diameter approximately equal to the outer diameter of substantially cylindrical portion 646 to a diameter that is greater than or approximately equal to an outer diameter of arrow point 650.

In at least one embodiment, and as seen in FIG. 13, as threaded end 641 of insert 640 is threaded into arrow point 650, the inner surface of the internal taper defined in arrow point 650 may be brought to bear against the outer surface of tapered leading end 642, resulting in a tight engagement between arrow point 650 and arrow shaft 620. Similar to previous embodiments, the frustoconical shape of tapered leading end 642 may guide arrow point 650 into axial alignment with insert 640 and arrow shaft 620.

Figure 14:
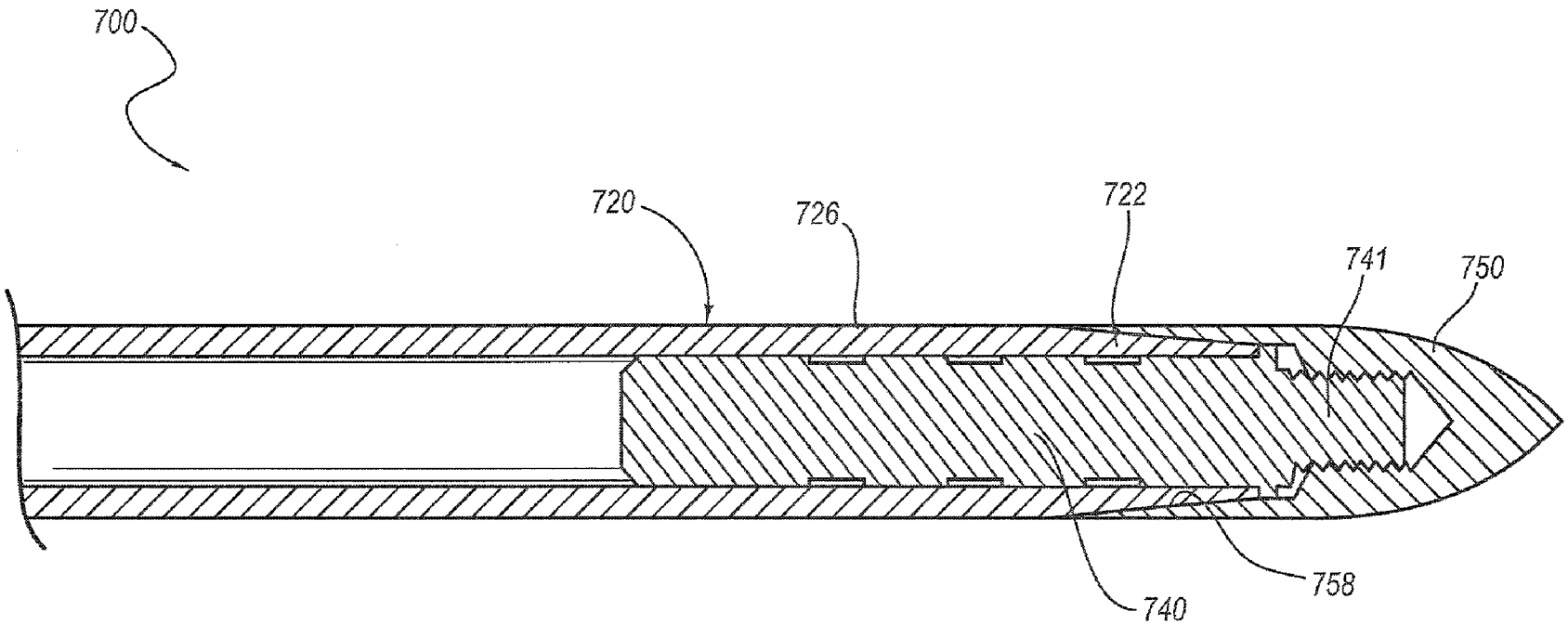
FIG. 14 is a cross-sectional side view of an arrow apparatus according to an additional embodiment.

FIG. 14 is a cross-sectional side view of an arrow apparatus 700 according to an additional embodiment. As seen in this figure, exemplary arrow apparatus 700 may comprise an arrow shaft 720, an insert 740, and an arrow point 750. Similar to the exemplary embodiment illustrated in FIG. 12, in at least one embodiment arrow shaft 720 may comprise a tapered leading end 722 and a substantially cylindrical portion 726 formed integrally with its outer surface. However, rather than comprising a tapered trailing end (such as tapered trailing end 524 in FIG. 12), the remainder of the outer surface of arrow shaft 720 may have a diameter that is substantially equal to the outer diameter of arrow point 550.

In at least one embodiment, and as seen in FIG. 14, as threaded end 741 of insert 740 is threaded into arrow point 750, the outer surface of tapered leading end 722 may be brought to bear against the inner surface of tapered portion 758 of the internal aperture defined within arrow point 750, resulting in a tight engagement between arrow point 750 and arrow shaft 720. Similar to previous embodiments, the frustoconical shape of tapered leading end 722 may guide arrow point 750 into axial alignment with arrow shaft 720.

Figure 15:
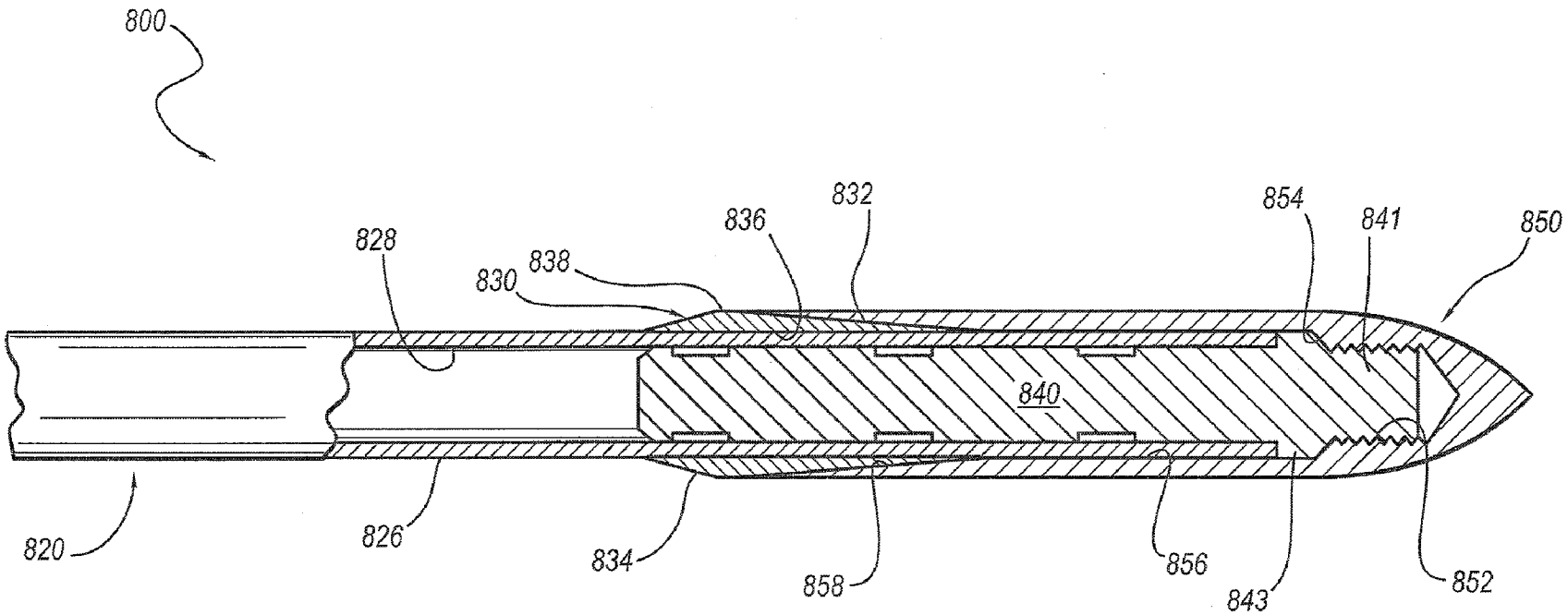
FIG. 15 is a cross-sectional side view of an arrow apparatus according to an additional embodiment.

FIG. 15 is a cross-sectional side view of an arrow apparatus 800 according to an additional embodiment. As seen in this figure, exemplary arrow apparatus 800 may comprise an arrow shaft 820, an arrow point alignment structure 830, an insert 840, and an arrow point 850. In at least one embodiment, alignment structure 830 may comprise a substantially cylindrical inner surface 836 and an outer surface comprising a tapered leading end 832, a tapered trailing end 834, and a substantially cylindrical portion 838. As with alignment structure 30 discussed above, the diameter of inner surface 836 of alignment structure 830 may be slightly greater than the outer diameter of arrow shaft 820 so that a portion of arrow shaft 820 may be disposed within alignment structure 830. In addition, an internal aperture may be defined within arrow point 850 comprising a threaded portion 852, a shoulder portion 854, a substantially cylindrical portion 856, and a tapered portion 858.

In at least one embodiment, the inner surface 836 of alignment structure 830 may be disposed about and contact an outer surface 826 of arrow shaft 820 without being adhered, bonded, or otherwise affixed to this outer surface 826. Thus, in certain embodiments, alignment structure 830 may be disposed about, but remain movable relative to, arrow shaft 820. Instead, in some embodiments, the tapered leading end 832 of arrow point alignment structure 830 may be adhered, bonded, or otherwise affixed to the tapered portion 858 of arrow point 850 to effectively secure alignment structure 830 to arrow apparatus 800.

In the exemplary embodiment illustrated in FIG. 15, and in contrast to certain previous embodiments, as threaded end 841 of insert 840 is threaded into and received by threaded portion 852 of arrow point 850, the beveled lip portion 843 of insert 840 may be brought to bear and rest against the beveled shoulder portion 854 of arrow point 850. In at least one embodiment, the beveled lip portion 843 of insert 840 may bear against the beveled shoulder portion 854 of arrow point 850 to securely attach arrow point 850 to arrow shaft 850 and to prevent threaded end 841 from being completely threaded into and within threaded portion 852 of arrow point 850.

In addition, as with certain previous embodiments, inner surface 836 of alignment structure 830 and outer surface 826 of arrow shaft 820 may be shaped such that, when arrow shaft 820 is disposed within alignment structure 830, alignment structure 830 may be brought into axial alignment with arrow shaft 820. In other words, the cylindrically shaped inner surface 836 of alignment structure 830 may be proportional to, and just slightly larger than, the cylindrically shaped outer surface 826 of arrow shaft 820 so that the longitudinal axes of arrow shaft 820 and alignment structure 830 are brought into alignment with one another when arrow shaft 820 is inserted and disposed within alignment structure 830. Similarly, the tapered leading end 832 of alignment structure 830 may be shaped so as to bring arrow point 850 into axial alignment with alignment structure 830. In other words, as seen in FIG. 15, as the tapered portion 858 of the internal aperture defined within arrow point 850 mates with and is brought to bear against the outer surface of tapered leading end 832 of alignment structure 830, the frustoconical shape of tapered leading end 832 may guide arrow point 850 into axial alignment with alignment structure 830.

As with previous embodiments, arrow point alignment structure 830 may be manufactured in any number of shapes and sizes and may be adapted for use with arrow shafts of differing diameters. For example, arrow point 850 may be adapted to fit or mate with an arrow shaft 820 of any outer diameter simply by choosing an arrow point alignment structure 830 that comprises an inner surface 836 having a diameter that is just slightly larger than the outer diameter of the desired arrow shaft 820. In many embodiments, after an appropriate alignment structure 830 is selected, the tapered leading end 832 of alignment structure 830 may be adhered, bonded, or otherwise affixed to the tapered portion 858 of arrow point 850 to effectively secure alignment structure 830 to arrow point 850. In this exemplary embodiment, the inner surface 836 of alignment structure 830 may be disposed about and contact an outer surface 826 of arrow shaft 820 without being adhered, bonded, or otherwise affixed to this outer surface 826. Thus, in the exemplary embodiment illustrated in FIG. 15, a single arrow point (such as arrow point 850) may be adapted for use with a plurality of arrow shafts of differing diameters by matching the arrow point with an alignment structure having an inner diameter that corresponds to the outer diameter of the arrow shaft, thus eliminating the need to manufacture discrete arrow points for each desired arrow shaft diameter.

Figure 16:
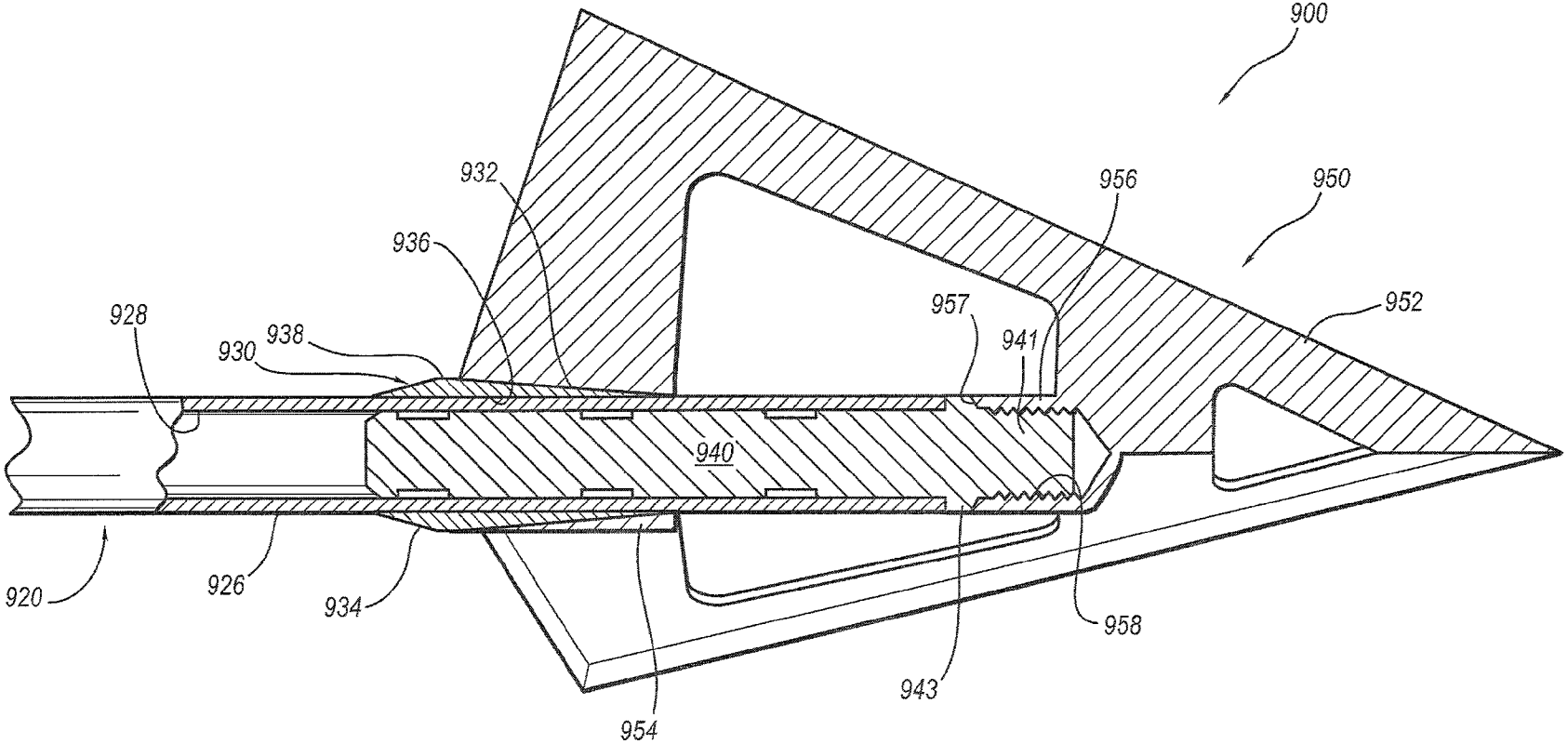
FIG. 16 is a cross-sectional side view of an arrow apparatus according to an additional embodiment.

As detailed above, any of the various arrow apparatuses described and/or illustrated herein may comprise a broadhead-type arrow point, as opposed to the field point-type arrow points previously described and illustrated. For example, as illustrated in the cross-sectional view of FIG. 16, an exemplary arrow apparatus 900 may comprise an arrow shaft 920, an arrow point alignment structure 930, an insert 940, and a broadhead arrow point 950. Broadhead 950 generally represents any form or type of broadhead; including, for example, unitary, expandable, and replaceable fixed-blade broadheads. FIG. 16 shows the broadhead arrow point 950 as a unitary structure having a single-piece, integrally formed construction. In at least one embodiment, broadhead 950 comprises a plurality of blades 952, each of which extends from a common frontal point to a base. In certain embodiments, the base of each blade 952 may be connected to a tapered collar 954. Tapered collar 954 may define a central aperture that is in axial alignment with a central hub structure 956 formed in the broadhead interior of each blade 952 and positioned between the point of convergence of the blades and tapered collar 954. Central hub structure 956 may comprise a plurality of internal threads 958 configured to receive and threadably mate with threaded end 941 of insert 940.

In at least one embodiment, the inner surface of tapered collar 954 may embody the inverse of the generally frustoconical shape of a tapered leading end 932 of alignment structure 930. In addition, the diameter of tapered leading end 932 of alignment structure 930 may taper from a diameter approximately equal to the outer diameter of arrow shaft 920 to a diameter that is greater than or substantially equal to an outer diameter of tapered collar 954. Similar to the exemplary embodiment illustrated in FIG. 15, in at least one embodiment the tapered leading end 932 of alignment structure 930 may be adhered, bonded, or otherwise affixed to the tapered inner surface of tapered collar 954 of arrow point 950. In this exemplary embodiment, as threaded end 941 of insert 940 is threaded into central hub structure 956, the beveled lip portion 943 of insert, 940 may be brought to bear against the beveled bottom face 957 of central hub structure 956. In at least one embodiment, the beveled lip portion 943 of insert 940 may bear against the beveled bottom face 957 of central hub structure 956 to securely attach arrow point 950 to shaft 920 and to prevent threaded end 941 from being completely threaded into and within central hub structure 956.

As mentioned above, any one of the various arrow apparatuses described and/or illustrated herein may adapted for use with so-called hidden insert technology, such as the hidden insert embodiments described and illustrated in U.S. Pat. Nos. 7,004,859 and 7,115,055. For example, as illustrated in the cross-sectional side view of FIG. 17, an exemplary arrow apparatus 1000 may comprise an arrow shaft 1020, an arrow point alignment structure 1030, and an arrow point 1050 attached to a hidden insert 1060 by an adapter 1040. In at least one embodiment, alignment structure 1030 may be adhered, bonded, or otherwise affixed to the outer surface of arrow shaft 1020.

Figure 17:
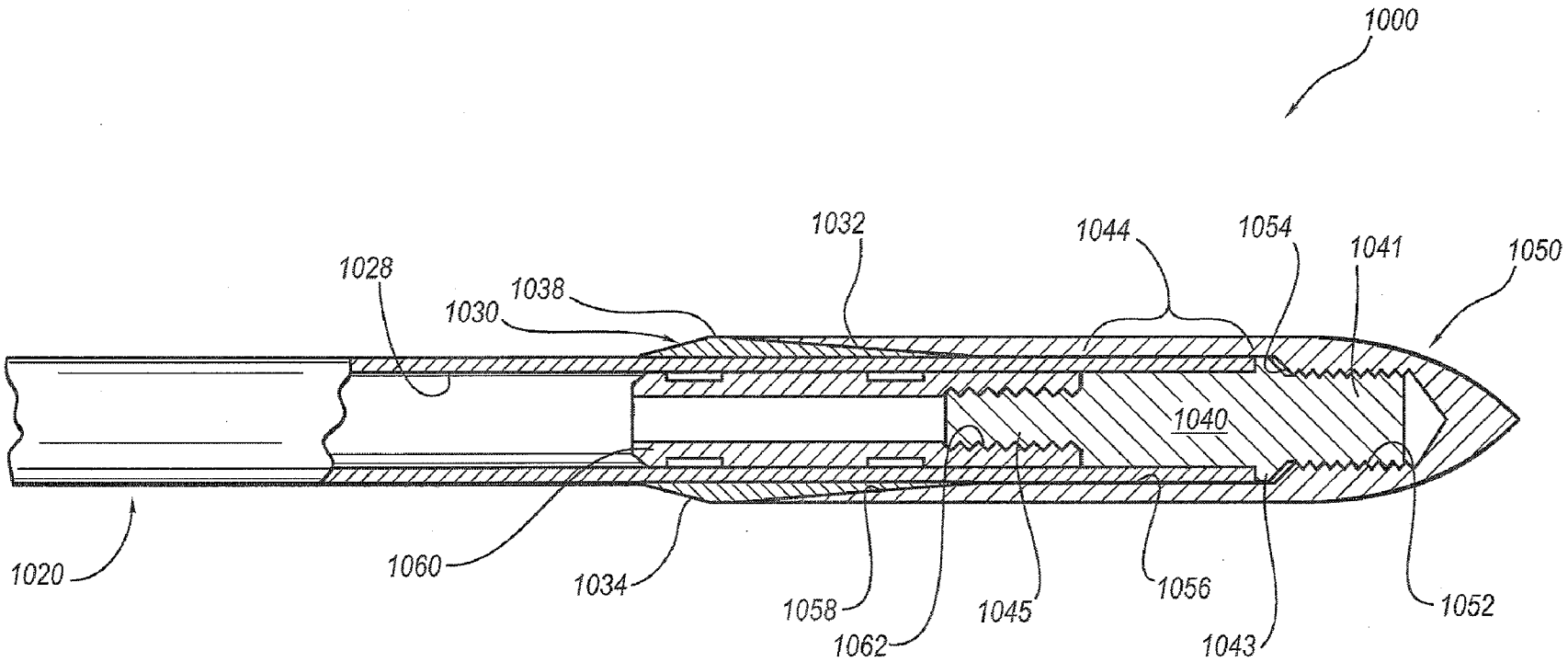
FIG. 17 is a cross-sectional side view of an arrow apparatus according to an additional embodiment.

Adapter 1040 generally represents any type or form of structure capable of removably attaching an arrow point, such as arrow point 1050, to an insert disposed within an arrow shaft, such as hidden insert 1060. Adapter 1040 may be formed in any number of shapes and sizes and of any combination of materials, such as aluminum, stainless steel, brass, or the like. The size of adapter 1040 may also be adapted as necessary for use with arrow shafts of varying sizes and diameters. In the exemplary embodiment illustrated in FIG. 17, adapter 1040 may comprise a first threaded end 1041, a lip portion 1043, a shank portion 1044, and a second threaded end 1045. In at least one embodiment, the diameter of shank portion 1044 and second threaded end 1045 may be less than the inner diameter of arrow shaft 1020 so that a portion of adapter 1040 (e.g., shank portion 1044 and second threaded end 1045) may be inserted within arrow shaft 1020, as seen in FIG. 17. In contrast, the diameter of lip portion 1043 may be greater than the inner diameter of arrow shaft 1020 to prevent adapter 1040 from being completely inserted within arrow shaft 1020. In at least one embodiment, the diameter of lip portion 1043 is substantially equal to the outer diameter of arrow shaft 1020.

Hidden insert 1060 generally represents any type or form of insert capable of being completely disposed within the shaft of an arrow, such as arrow shaft 1020. In many embodiments, the outer surface of insert 1060 may be adhered, bonded, or otherwise affixed to the inner surface of arrow shaft 1020 to securely affix insert 1060 within arrow shaft 1020. In at least one embodiment, insert 1060 comprises a threaded portion 1062 configured to threadably receive an opposing structure, such as the second threaded end 1045 of adapter 1040. For example, as illustrated in FIG. 17, threaded portion 1062 may be configured to threadably receive and mate with the second threaded end 1045 of adapter 1040 to removably and securely attach adapter 1040 to insert 1060 and, in turn, arrow shaft 1020.

In the exemplary embodiment illustrated in FIG. 17, the first threaded end 1041 of adapter 1040 may be threaded into and mate with a threaded portion 1052 of arrow point 1050. In addition, as the first threaded end 1041 of adapter 1040 is threaded into threaded portion 1052 of arrow point 1050, a tapered portion 1058 of arrow point 1050 may contact, and more specifically may receive and mate with, a tapered leading end 1032 of arrow point alignment structure 1030. That is, tapered portion 1058 may embody the inverse of the generally frustoconical shape of tapered leading end 1032 of alignment structure 1030 such that, as the first threaded end 1041 of adapter 1040 is threaded into threaded portion 1052 of arrow point 1050, the outer surface of tapered leading end 1032 may be brought to bear against the tapered portion 1058 of the internal aperture defined within arrow point 1050, resulting in a tight engagement between arrow point 1050 and alignment structure 1030, and thus alignment between arrow point 1050 and arrow shaft 1020.

In at least one embodiment, alignment structure 1030 may be positioned on arrow shaft 1020 so as to prevent threaded end 1041 of insert 1040 from being completely threaded into threaded portion 1052 of arrow point 1050. In other words, the distance between the tapered leading end 1032 of alignment structure 1030 and the leading end of arrow shaft 1020 may be chosen such that, as insert 1040 is threaded into arrow point 1050, the outer surface of tapered leading end 1032 may bear against the inner surface of tapered portion 1058 of the internal aperture defined within arrow point 1050 to prevent lip portion 1043 from contacting shoulder portion 1054 of arrow point 1050. Alternatively, the distance between the tapered leading end 1032 of alignment structure 1030 and the leading end of arrow shaft 1020 may be chosen so that lip portion 1043 bears against shoulder portion 1054 of arrow point 1050 at the same time that the outer surface of tapered leading end 1032 bears against the tapered portion 1058 of the internal aperture defined within arrow point 1050.

The exemplary adapter illustrated in FIG. 17 may also be used in connection with broadhead-type arrow points, as opposed to the field point-type arrow points previously described and illustrated. For example, as illustrated in the cross-sectional view of FIG. 18, an exemplary arrow apparatus 1100 may comprise an arrow shaft 1120, an arrow point alignment structure 1130, and a broadhead arrow point 1150 attached to a hidden insert 1160 by an adapter 1140. In at least one embodiment, alignment structure 1130 may be adhered, bonded, or otherwise affixed to the outer surface of arrow shaft 1120. In addition, as with previous embodiments, hidden insert 1160 may comprise a threaded portion 1162 configured to threadably receive an opposing structure, such as the second threaded end 1145 of adapter 1140. For example, as illustrated in FIG. 18, threaded portion 1162 may be configured to threadably receive and mate with the second threaded end 1145 of adapter 1140 to removably and securely attach adapter 1140 to insert 1160 and, in turn, arrow shaft 1120.

Figure 18:
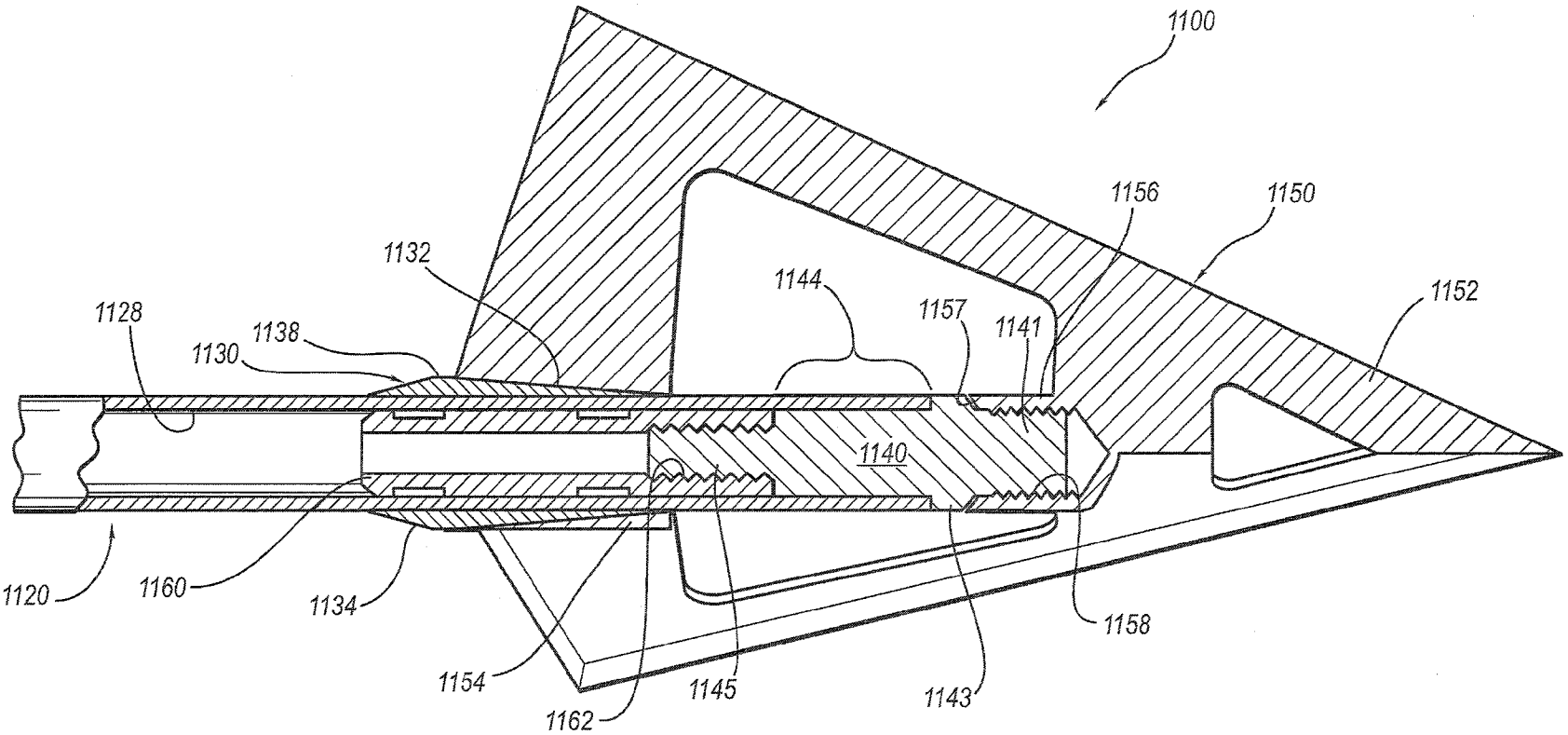
FIG. 18 is a cross-sectional side view of an arrow apparatus according to an additional embodiment.

In addition, in the exemplary embodiment illustrated in FIG. 18, the first threaded end 1141 of adapter 1140 may be threaded into and mate with internal threads provided within a central hub structure 1156 of arrow point 1150. In addition, as the first threaded end 1141 of adapter 1140 is threaded into central hub structure 1156 of arrow point 1150, the inner surface of a tapered collar 1154 of arrow point 1150 may contact, and more specifically may receive and mate with, a tapered portion 1132 of alignment structure 1130. That is, the tapered inner surface of tapered collar 1154 may embody the inverse of the generally frustoconical shape of tapered leading end 1132 of alignment structure 1130 such that, as the first threaded end 1141 of adapter 1140 is threaded into central hub structure 1156 of arrow point 1150, the outer surface of tapered leading end 1132 may be brought to bear against the inner surface of tapered 1154 of arrow point 1150, resulting in a tight engagement between arrow point 1150 and alignment structure 1130, and thus alignment between the arrow point 1150 and shaft 1120.

As with previous embodiments, alignment structure 1130 may be positioned on arrow shaft 1120 so as to prevent threaded end 1141 of insert 1140 from being completely threaded into central hub structure 1156 of arrow point 1150. In other words, the distance between the tapered leading end 1132 of alignment structure 1130 and the leading end of arrow shaft 1120 may be chosen such that, as insert 1140 is threaded into central hub structure 1156 of arrow point 1150, the outer surface of tapered leading end 1132 may bear against the inner surface of tapered collar 1154 of arrow point 1150 to prevent lip portion 1143 from contacting the bottom face 1157 of central hub structure 1156. Alternatively, the distance between the tapered leading end 1132 of alignment structure 1130 and the leading end of arrow shaft 1120 may be chosen so that lip portion 1143 bears against face 1157 of central hub structure 1156 at the same time that the outer surface of tapered leading end 1132 bears against the inner surface of tapered collar 1154 of arrow point 1150.

Figure 19:
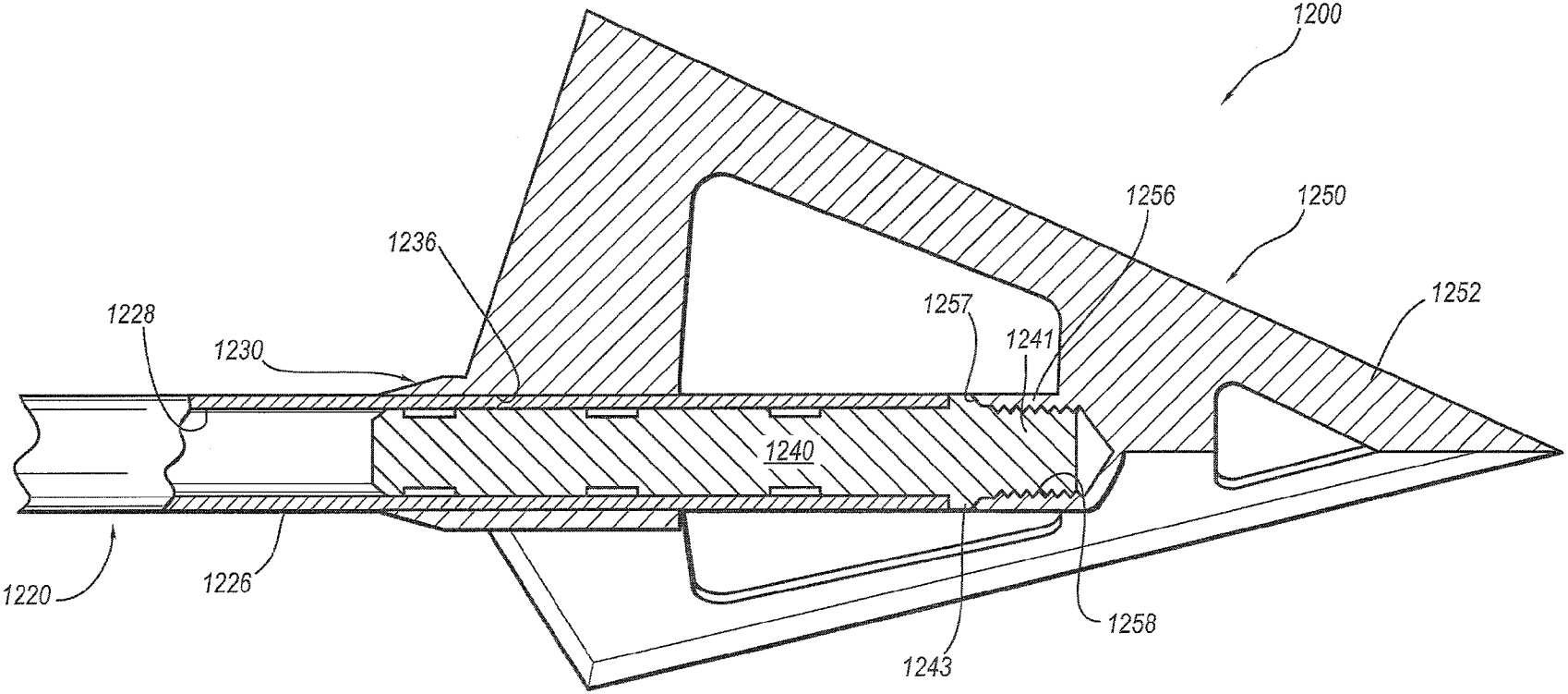
FIG. 19 is a cross-sectional side view of an arrow apparatus according to an additional embodiment.

Although the various arrow point alignment structures described and/or illustrated herein have been characterized as discrete and separately formed elements, in at least one embodiment the alignment structure may be integrally formed with the arrow point. For example, as illustrated in the cross-sectional side view of FIG. 19, an arrow apparatus 1200 according to an additional embodiment may comprise an arrow shaft 1220, an insert 1240, and a broadhead arrow point 1250. In at least one embodiment, arrow point 1250 may comprise a plurality of blades 1252 that each extend from a common frontal point to a base. In certain embodiments, the base of each blade 1252 may be integrally formed with or connected to an arrow point alignment structure 1230. Alignment structure 1230 may define a central aperture that is in axial alignment with a central hub structure 1256 provided on the underside of each blade 1252 and positioned between the common frontal point and alignment structure 1230. Central hub structure 1256 may comprise a plurality of internal threads 1258 configured to receive and threadably mate with threaded end 1241 of insert 1240.

Alignment structure 1230 generally represents any type or form of structure capable of axially aligning arrow point 1250 with arrow shaft 1220. In at least one embodiment, alignment structure 1230 may be sized to contact, and more specifically receive and mate with, at least a portion of arrow shaft 1220. In addition, an inner surface 1236 of alignment structure 1230 may be shaped such that, when arrow shaft 1220 is disposed within alignment structure 1230, alignment structure 1230 (and thus, in turn, arrow point 1250) may be brought into axial alignment with arrow shaft 1220. In other words, the cylindrically shaped inner surface 1236 of alignment structure 1230 may be proportional to, and just slightly larger than, the cylindrically shaped outer surface 1226 of arrow shaft 1220 so that the longitudinal axes of arrow shaft 1220 and alignment structure 1230 are brought into axial alignment with one another when arrow shaft 1220 is inserted and disposed within alignment structure 1230. Arrow point 1250, and alignment structure 1230 integrally formed therewith, may also be manufactured in any number of sizes so as to be adapted for use with arrow shafts of differing diameters.

Similar to the exemplary embodiments illustrated in FIGS. 15 and 16, as threaded end 1241 of insert 1240 is threaded into central hub structure 1256, the beveled lip portion 1243 of insert 1240 may be brought to bear against the beveled bottom face 1257 of central hub structure 1256. In at least one embodiment, the beveled lip portion 1243 of insert 1240 may bear against the beveled bottom face 1257 of central hub structure 1256 to securely attach arrow point 1250 to shaft 1220 and to prevent threaded end 1241 from being completely threaded into and within central hub structure 1256.

It is desired that the embodiments described herein be considered in all respects illustrative and not restrictive and that reference be made to the appended claims and their equivalents for determining the scope of the instant disclosure. For ease of use, the words "including" and "having," as used in the specification and claims, are interchangeable with and have the same meaning as the word "comprising."

What is claimed is:

1. An arrow apparatus, comprising:

a hollow arrow shaft having an outer surface, an inner surface, a leading end, and a trailing end;

an arrow point alignment structure positioned on the outer surface of the arrow shaft at a location proximal of the leading end of the arrow shaft, the arrow point alignment structure comprising a tapered portion;

a single-piece arrow point in contact with the leading end of the arrow shaft and in contact with the tapered portion of the arrow point alignment structure.

2. The arrow apparatus of claim 1, wherein the entire arrow point alignment structure is spaced proximal of the leading end of the arrow shaft.

3. The arrow apparatus of claim 1, wherein the arrow point includes first and second axially spaced apart contact points, the first contact point being arranged to contact the leading end of the arrow shaft, and the second contact point being arranged to contact the arrow point alignment structure.

4. The arrow apparatus of claim 1, wherein the arrow point alignment structure is affixed to a portion of the arrow point.

5. The arrow apparatus of claim 1, further comprising an insert at least partially disposed within the arrow shaft, the insert defining the leading end of the arrow shaft.

6. The arrow apparatus of claim 1, wherein the arrow point alignment structure is movable relative to the outer surface of the arrow shaft.

7. The arrow apparatus of claim 1, further comprising a tapered aperture defined within the arrow point.

8. The arrow apparatus of claim 1, wherein the arrow point is a field point and the tapered aperture is configured to receive and contact at least a portion of the tapered leading end of the arrow point alignment structure.

9. The arrow apparatus of claim 1, wherein the arrow point is a broadhead and comprises a collar, the collar being configured to receive and contact at least a portion of the tapered leading end of the arrow point alignment structure.

10. The arrow apparatus of claim 1, wherein the arrow point alignment structure brings the arrow point into axial alignment with the arrow shaft.

11. The arrow apparatus of claim 1, wherein the arrow point alignment structure is in contact with the outer surface of the arrow shaft.

12. An arrow point for attachment to an arrow shaft, the arrow point comprising:

a leading end;

a trailing end;

a threaded aperture defined within the arrow point proximate the leading end;

a tapered aperture defined within the arrow point and having a tapered surface proximate the trailing end;

wherein the tapered surface of the tapered aperture is configured to contact at least a corresponding tapered surface of an arrow point alignment structure that is in contact with an outer surface of an arrow shaft;

wherein the arrow point is formed as an integral, single-piece structure.

13. The arrow point of claim 12, wherein the arrow point is a field point.

14. The arrow point of claim 12, wherein the arrow point is a broadhead and comprises a tapered collar that defines the tapered aperture.

15. The arrow point of claim 12, wherein the threaded aperture and tapered aperture are axially spaced apart.

16. A method of making an arrow apparatus, comprising:

providing a hollow arrow shaft, a unitary, integral, single-piece arrow point, and an arrow point alignment structure, the arrow shaft having an inner surface, an outer surface, a leading end, and a trailing end, the arrow point having axially spaced apart first and second contact points, the arrow point alignment structure having a tapered portion;

positioning the arrow point alignment structure spaced proximal of the leading end of the arrow shaft in contact with the outer surface of the arrow shaft;

positioning the arrow point in contact with the leading end of the arrow shaft and in contact with the tapered portion of the arrow point alignment structure to axially align the arrow point alignment structure with the arrow shaft.

17. The method of claim 16, wherein the arrow point includes a tapered aperture defined within the arrow point, and positioning the arrow point in contact with the tapered portion of the arrow point alignment structure includes contacting the tapered portion of the arrow point alignment structure with the tapered aperture.

18. The method of claim 17, wherein positioning the arrow point alignment structure spaced proximal of the leading end of the arrow shaft includes spacing the arrow point alignment structure a predetermined distance from the leading end of the arrow shaft.

19. The method of claim 16, further comprising:

providing an arrow shaft insert;

disposing at least a portion of an insert within the arrow shaft, the insert defining the leading end of the arrow shaft.

20. The method of claim 16, further comprising affixing the arrow point alignment structure to the arrow point.

21. A broadhead arrow point assembly, comprising:

an integral, single-piece broadhead arrow point having a collar, the collar defining a collar aperture;

an arrow point alignment structure having a tapered portion, the tapered portion being in contact with the collar aperture, the arrow point alignment structure being configured to align axially the broadhead arrow point with an arrow shaft to which the broadhead arrow point is mounted.

22. The broadhead arrow point assembly of claim 21, wherein the collar aperture includes a tapered surface that contacts the tapered portion of the arrow point alignment structure.

23. The broadhead arrow point assembly of claim 21, wherein when the broadhead arrow point is mounted to an arrow shaft, the arrow point alignment structure contacts an outer surface of the arrow shaft.

24. The broadhead arrow point assembly of claim 21, wherein the broadhead arrow point includes a distal end portion and a proximal end portion, the threaded aperture being positioned at the distal end portion and the collar being positioned at the distal end portion at a location axially spaced apart from the threaded aperture.

25. A method of making an arrow apparatus, comprising:

providing a hollow arrow shaft, an arrow point, and an arrow point alignment structure, the arrow shaft having an inner surface, an outer surface, a leading end, and a trailing end, the arrow point having axially spaced apart first and second contact points, the arrow point alignment structure having a tapered portion;

positioning the arrow point alignment structure spaced proximal of the leading end of the arrow shaft in contact with the outer surface of the arrow shaft;

positioning the arrow point in contact with the leading end of the arrow shaft and in contact with the tapered portion of the arrow point alignment structure to axially align the arrow point alignment structure with the arrow shaft;

wherein the arrow point includes a tapered aperture defined within the arrow point, and positioning the arrow point in contact with the tapered portion of the arrow point alignment structure includes contacting the tapered portion of the arrow point alignment structure with the tapered aperture.

26. A method of making an arrow apparatus, comprising:

providing a hollow arrow shaft, an arrow point, and an arrow point alignment structure, the arrow shaft having an inner surface, an outer surface, a leading end, and a trailing end, the arrow point having axially spaced apart first and second contact points, the arrow point alignment structure having a tapered portion;

positioning the arrow point alignment structure spaced proximal of the leading end of the arrow shaft in contact with the outer surface of the arrow shaft;

positioning the arrow point in contact with the leading end of the arrow shaft and in contact with the tapered portion of the arrow point alignment structure to axially align the arrow point alignment structure with the arrow shaft;

providing an arrow shaft insert;

disposing at least a portion of an insert within the arrow shaft, the insert defining the leading end of the arrow shaft;

affixing the arrow point alignment structure to the arrow point.

27. An arrow apparatus, comprising:

a hollow arrow shaft having an outer surface, an inner surface, a leading end, and a trailing end;

an arrow point alignment structure positioned on the outer surface of the arrow shaft at a location proximal of the leading end of the arrow shaft, the arrow point alignment structure comprising a tapered portion;

an arrow point in contact with the tapered portion of the arrow point alignment structure and overlapping a portion of the arrow shaft, wherein the arrow point includes at least one blade that overlaps a portion of the arrow shaft.

28. An arrow apparatus, comprising:

a hollow arrow shaft having an outer surface, an inner surface, a leading end, and a trailing end;

an arrow point alignment structure positioned on the outer surface of the arrow shaft at a location proximal of the leading end of the arrow shaft, the arrow point alignment structure comprising a tapered portion;

an arrow point in contact with the leading end of the arrow shaft and in contact with the tapered portion of the arrow point alignment structure;

wherein the arrow point alignment structure is affixed to a portion of the arrow point.

29. An arrow apparatus, comprising:

a hollow arrow shaft having an outer surface, an inner surface, a leading end, and a trailing end;

an arrow point alignment structure positioned on the outer surface of the arrow shaft at a location proximal of the leading end of the arrow shaft, the arrow point alignment structure comprising a tapered portion;

an arrow point in contact with the leading end of the arrow shaft and in contact with the tapered portion of the arrow point alignment structure;

an insert at least partially disposed within the arrow shaft, the insert defining the leading end of the arrow shaft.

30. A method of making an arrow apparatus, comprising:

providing a hollow arrow shaft, an arrow point, an arrow shaft insert, and an arrow point alignment structure, the arrow shaft having an inner surface, an outer surface, a leading end, and a trailing end, the arrow point having axially spaced apart first and second contact points, the arrow point alignment structure having a tapered portion;

positioning the arrow point alignment structure spaced proximal of the leading end of the arrow shaft in contact with the outer surface of the arrow shaft;

positioning the arrow point in contact with the leading end of the arrow shaft and in contact with the tapered portion of the arrow point alignment structure to axially align the arrow point alignment structure with the arrow shaft;

disposing at least a portion of the arrow shaft insert within the arrow shaft, the arrow shaft insert defining the leading end of the arrow shaft.

* * * * *